United States Patent [19]

Finch

[11] 4,283,031

[45] Aug. 11, 1981

[54] SYSTEM CONTROLLING APPARATUS WHICH COMPARES SIGNALS FROM SENSORS MONITORING PASSING OBJECTS WITH PRE-DETERMINED PARAMETER INFORMATION TO CONTROL THE SYSTEM

[76] Inventor: Colin M. Finch, Box 553, Lavington, New South Wales, Australia, 2641

[21] Appl. No.: 968,846

[22] Filed: Dec. 12, 1978

[30] Foreign Application Priority Data

Dec. 14, 1977 [AU] Australia ..... PD2772

[51] Int. Cl.[3] ..... B61L 11/08

[52] U.S. Cl. ..... 246/128; 235/92 TC; 246/247; 246/249; 324/179

[58] Field of Search ..... 198/502, 503, 856; 235/92 PC, 92 TC; 246/34 A, 77, 114 R, 114 A, 125–128, 247, 249, 255, 292, 293, 169 R, 169 A, 169 D, 182 A; 324/179; 340/38 L, 674, 146.3 K, 146.3 Y; 361/143; 364/436, 438, 478, 555, 562, 565

[56] References Cited

U.S. PATENT DOCUMENTS

| | | | |
|---|---|---|---|
| 3,144,225 | 8/1964 | Suerkemper et al. | 246/247 X |
| 3,610,920 | 10/1971 | Frielinghaus | 246/128 |
| 3,721,859 | 3/1973 | Blanyer | 246/249 X |
| 3,731,087 | 5/1973 | King | 246/169 D |
| 3,777,139 | 12/1973 | Peel | 246/128 X |
| 3,781,542 | 12/1973 | Brockman | 246/128 |
| 4,052,595 | 10/1977 | Erdmann et al. | 235/92 TC |
| 4,070,560 | 1/1978 | Blanyer | 235/92 TC |

FOREIGN PATENT DOCUMENTS

| | | | |
|---|---|---|---|
| 2652233 | 5/1978 | Fed. Rep. of Germany | 246/247 |

*Primary Examiner*—J. D. Miller
*Assistant Examiner*—Reinhard J. Eisenzopf
*Attorney, Agent, or Firm*—Cushman, Darby & Cushman

[57] ABSTRACT

A system controlling apparatus wherein an array of sensors are used for detecting information and for providing signals indicative of information concerning passing articles such as presence of an article at a sensor, number of articles passing, the direction of passing and the velocity of passing. Signal processing apparatus is comparing the signals with pre-determined parameter information as to the system and for providing control to the system in response to detecting equality and for providing overriding control to the system in response to detecting inequality. Each of the sensors is self-checking during the period an article is not present. The information detected by the sensors is converted to a simple binary high or low signal and such binary signals from all sensors are compared in a "look-up" table comparator arranged to recognize a particular pattern of highs and lows at its input and to provide an output to the system if it is in accordance with a pre-determined pattern corresponding to the pre-determined parameter information of the system.

9 Claims, 23 Drawing Figures

SYSTEM CONTROLLING APPARATUS WHICH COMPARES SIGNALS FROM SENSORS MONITORING PASSING OBJECTS WITH PRE-DETERMINED PARAMETER INFORMATION TO CONTROL THE SYSTEM

BACKGROUND OF THE INVENTION

This invention relates to a system controlling apparatus and relates particularly, but not exclusively, to such for use in railway crossing signalling installations.

In its broadest aspect the invention has application to controlling apparatus, dependent on articles as they pass a series of adjacent sensors. Such might be where articles are moving past sensors on a conveyor belt and wherein operations are required to be performed either on the articles or at stations which receive the articles or where certain steps have to be taken as the articles pass. The articles, as they pass the sensors, cause generation of information concerning the passing of the articles such as presence of the article, number of articles passing and their speed of passing.

When applied to railway crossing signalling installations the sensors detect information as to the passing of train wheels at selected locations. The sensors detect information such as the presence of a train wheel at a sensor, the number of train wheels passing, the direction of passing and the velocity of passing. Such information is compared with similar information obtained from other sensors in the crossing installation to see if the same number of wheels are passing those sensors, whether the direction of movement has changed and whether the velocity has changed. All this information is fed to a controller which acts on the information and decides whether actions should be taken downstream having regard to the information detected regarding the passing of the train wheels. Such information may be that a warning signal at the crossing should be activated and/or boom gates lowered.

DESCRIPTION OF PRIOR ART

In the railway crossing signalling art, warning lamps and/or gates have been used to indicate that a train is approaching and that vehicles on the road crossing the railroad tracks should give way to the train. In suburban areas this warning facility is reasonably acceptable due to fixed train schedules and an aware public. Automatic rail sensing means are used to trigger the warning facility and these are supplemented by manual operation of further switches by a railway employee where there are complex operations. The railway employees watch time tables and operate the further switches in accordance with the expected time of arrival of a train. Thus, in suburban areas there is often a double system to ensure that the warning facility operates. In country areas, however, schedules are not kept trains are less frequent and the cost of staffing crossings to operate further switches is prohibitive. Therefore in country areas a railway crossing installation is controlled only by the automatic rail track sensors and the information detected thereby.

Further, problems arise in country areas as ingress of moisture to the automatic rail switches and/or their circuits can cause malfunctioning. The warning facility then operates continuously since the sensors provide a signal which represents that a train is shorting the switches. Sometimes to avoid this problem the warning facility such as flashing lights is manually switched off and/or rendered inoperative so as to avoid giving a false signal. Because false signals are common, attributable to one or more of the above problems, locals in country areas often regard the warning signalling as incorrect and proceed to cross. The record of serious accidents occurring at country crossings as compared to suburban crossings is such that this is a major problem.

Additionally, the present automatic rail switches in existing systems can not easily distinguish if the whole of a train has passed the crossing. For example, a freight train having a number of small cars therein can easily lose one or more cars in the crossing regions and in certain instances the lost cars can come to rest over the crossing road with disastrous consequences. The present automatic rail switches do not detect unambiguous information as for example, information that the whole length of a train has cleared the crossing but instead they operate when the sensors and circuits on each side of the crossing are clear, but not when the actual road is clear and so they are inadequate in this situation.

Further, the present systems are not sensitive to train speed or direction. Thus, the warning signal as indicated by flashing lights and/or by bells or by gates is the same irrespective of where the train is within the crossing system or how fast the train is approaching the road. Desirably, a fixed time warning signal is required independent of the time of arrival of the train in the system. For example to obtain a warning 15 seconds before a train reaches a road crossing when it is travelling at say 113 Kph will require a sensor located 469 meters from the road. However, if the train were travelling at only 3 Kph with the sensor 469 meters away from the road, then it will not reach the road for nearly nine minutes, yet in the prior art the warning signalling commenced when the train passed the sensor. It is believed that this problem is one of the reasons why there are serious accidents at country crossings as after a long delay the occupants of cars have proceeded to cross when in fact the train is then almost at the road.

A further problem occurs in country areas when a train is simply moving back and forth and moves into the crossing system but not over the road. The present automatic rail switches can not sense that the train has passed the sensor in one direction dwelled and then returned in the same direction and hence it has not been possible to immediately render inoperative the warning facility. Hitherto, in this situation, the warning facility was rendered inoperative automatically after a set time.

A further problem with the known automatic rail track switches is that they can not be checked as to their operation except by physical shorting. This is done most commonly by a manual operator with a shunt or by operating a shunting relay. Either method is only performed occasionally in order to rebalance a track circuit or for maintenance and will cause the track circuit to be inoperative for a significant time. The present system preferably uses a sensor of the type described in our copending U.S. application Ser. No. 968,847 in the name of the present applicant and having the same filing date as the present application which enables checking to occur continuously and automatically unless a train wheel is present at the sensor which is normally only a short time. The wheel presence will inhibit a check for safety reasons. Thus, with the present system and using the preferred transducer substantial unambiguous information and an accurate checking facility can be provided which provides for superior controlling of a crossing installation than hereto known.

SUMMARY OF THE INVENTION

Accordingly, it is an object of the present invention to provide an improved system controlling apparatus which reduces at least some of the problems outlined above. Particular embodiments of the invention will overcome nearly all of the prior art problems.

According to the present invention there is provided a system controlling apparatus comprising an array of sensors for detecting information and for providing signals containing information relating to passing articles. The information may be the presence of an article at a sensor, the number of articles passing the sensor, the direction and velocity of passing. The apparatus further comprises signal processing means for comparing the signals with predetermined parameter information as to the system and for providing control to control means of the system based on the information detected from a first sensor and an overriding control if the information detected from an adjacent sensor is different or if the information from the first sensor changed.

BRIEF DESCRIPTION OF DRAWINGS

In order that the invention can be more clearly ascertained a preferred construction for use in a railway crossing installation will now be described with reference to the accompanying drawings wherein.

DESCRIPTION OF PREFERRED EMBODIMENTS

Figure 1:
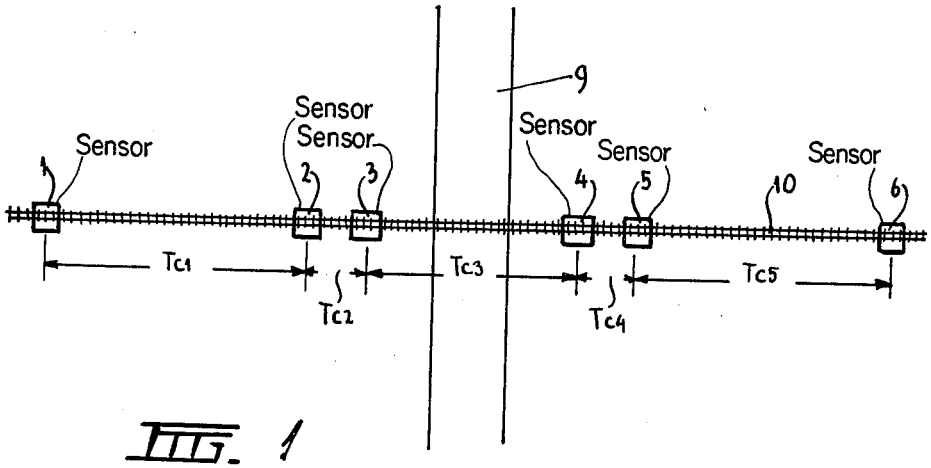
FIG. 1 shows a simple railway crossing system.

FIG. 1 shows a railway crossing signalling installation of very simple character with a road 9, and a railway line 10. A series of sensors 1 to 6 are shown spaced at critical locations along the length of the track 10 in the crossing area. The sensors 1 to 6 provide data relating to train wheel 150 movement at the respective points on the rail 10.

In existing railway art a length of track which constitutes an automatic rail switch and is used to detect a train is called a track circuit. In the system herein the sensors 1 to 6 are used instead of automatic rail track switches and in this case a track circuit becomes the distance between two sensors i.e. sensor 1 and sensor 2—(see TC1–TC5). With conventional track circuits it is possible to generate ambiguous information about train movements within the crossing area. With the use of sensors 1 to 6 as described herein, each track circuit TC1–TC5, regardless of length contains unambiguous information as to movement of the train. The sensors 1 to 6 can be any type of proximity sensor or switch sensor which will yield information as to presence of a train wheel 100, the number of train wheels passing, the direction of passing and/or velocity of the train wheel. It is particularly preferred to use a sensor of the type as described herein and in the aforementioned copending U.S. application.

A railway inspection train or a single engine train, hereinafter referred to as a "light-engine" is prevented from crossing the road 9, by train signals until it reaches TC 2 or TC 4 and then allowed to cross under controlled conditions. Track circuits TC2 and TC4 are placed immediately adjacent the road 9 and extend over a short length of approximately 15 meters. The spacing of the remaining sensors is at larger intervals and at required positions suitably in advance of the road 9.

Figure 2:
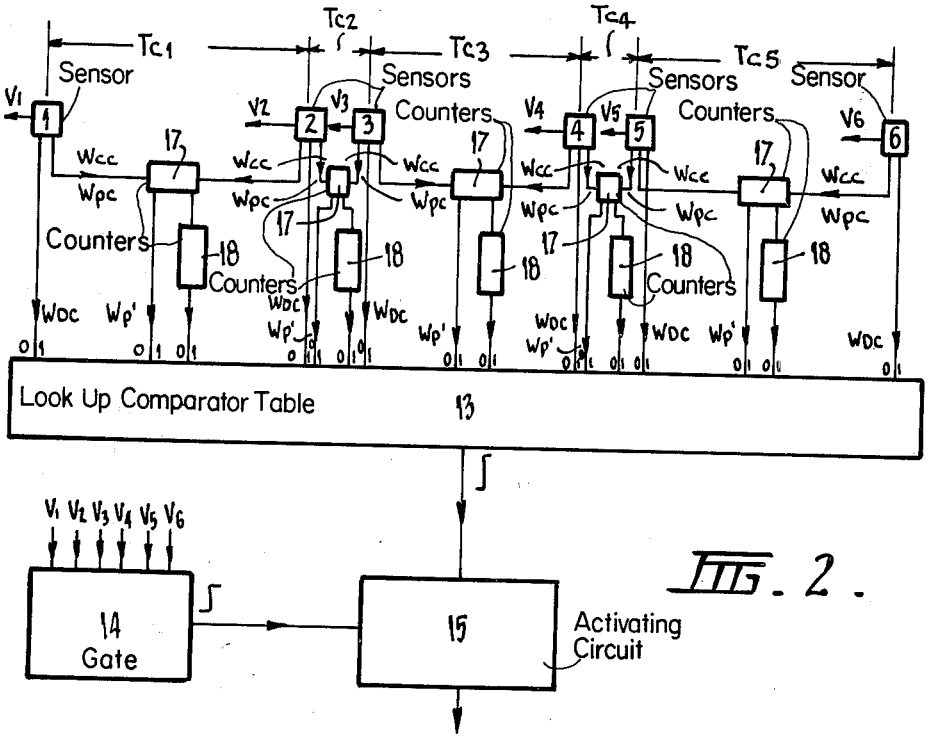
FIG. 2 shows a block circuit diagram of electronics used in the system.
Figure 3:
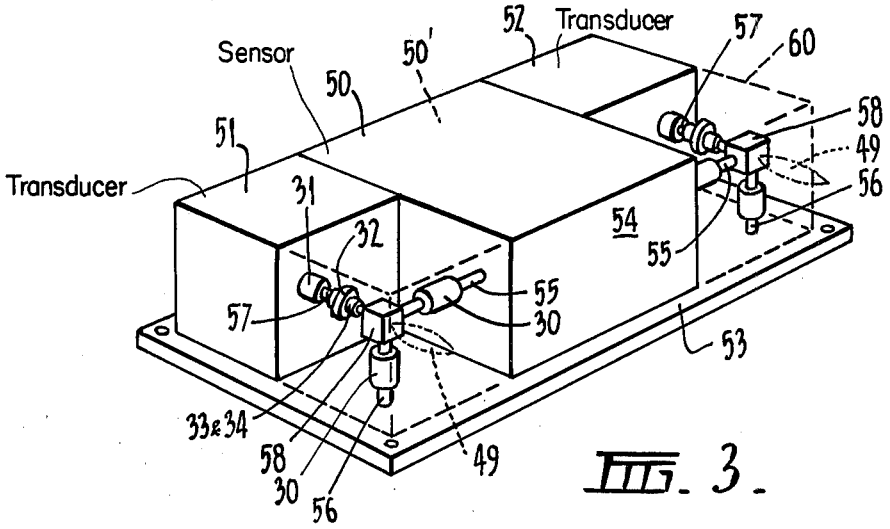
FIG. 3 shows a front perspective view of a preferred sensor for detecting the passing of train wheels.

Referring to FIG. 2 there is diagrammatically shown a block circuit arrangement of the system of the crossing installation shown in FIG. 1. There are five track circuits TC1 to TC5 a "look-up" comparator table 13, a gate 14 and a warning signal activating circuit 15. Each of the track circuits TC1–TC5 provides information as to presence of a train wheel, number of train wheels, i.e.—wheel count, direction of movement of train wheels and velocity. The wheel count data is passed from one track circuit to the next in a manner such that sensor 1 provides an "up-count" for each wheel 100 passing whilst sensor 2 provides a "down-count" as the train wheels 100 pass, cancelling the "up-count" in track circuit TC1. Simultaneously, with the "down-count" sensor 2 provides an "up-count" of the same train wheels 100 for track circuit TC2. Sensors 3, 4, 5 and 6 provide similar "up" and "down" counts for each of the track circuits so that as a train passes, the wheels 100 will be counted in a track circuit by one sensor and checked off by counting down with the next sensor. Thus, it is possible to detect if a train loses a car within the crossing area by indicating if the counted wheels do not correspond between the track circuits. The count in each track circuit is performed by counters 17. If the up and down counts do not correspond and cancel each other out, the respective track circuit will have a net value indicating that the required number of wheels has not passed and then counter 17 passes such information into the "look-up" table comparator 13 to provide a warning signal if required. Information such as train or no train (presence), light-engine, heavy-train (refer hereinafter to heavy engine), direction of movement, are also passed into the "look-up" table comparator 13. The velocity data is transmitted to the gate 14 and after a calculated or pre-set time to the warning signal activating circuit 15 so that a warning signal (flashing lights, or bells or boom gates) can be provided at that time dependent on the train velocity. Should the train velocity change during progress through the installation then the preset time of the warning can be appropriately changed. For example, when sensor 1 determines a particular train velocity it programs, through gate 14, the warning signal activating circuit 15 to provide a warning signal a set time after passing. If track sensors 1, 2 or 3 should sense that the velocity has increased a correction can be applied to the warning signal activating circuit 15 earlier or later as the case may be. The difference between a light-engine and a heavy-engine is detected by counting the number of wheels. The heavy-engine will always have a greater number of wheels than a light-engine. The "look-up" table comparator 13 is a simple comparator circuit which is pre-programmed to recognize data as to presence of train, light-engine, direction of movement in all track circuits, and an output signal is fed to the warning signal activating circuit 15 as required thereby indicating that a warning should be given. The "look-up" table comparator 13 is fed with simple binary presence or no presence signals relating to wheel presence and light engine or heavy-engine and direction of movement as will be explained hereinafter.

Referring now to FIGS. 3, 4, 5 and 6 there is shown a particularly preferred sensor for use in the railway signalling art for placing next to a train line for detecting information as to the proximity of a train wheel or other field disturbing means extending from the train (hereinafter referred to as train wheel). Such sensor is described in the aforesaid co-pending U.S. application.

The information is to the presence, velocity and direction of movement of a train wheel. The sensor shown generally by numeral 50 has two identical transducer elements 51 and 52 spaced apart a distance less than the diameter of the train wheel. Such spacing is important because the two transducers 51 and 52 are used to provide signals for subsequently providing unambiguous information as to the presence, velocity and direction of movement of the train wheel. If the transducers were spaced greater than the diameter of the wheel then it would be impossible to relate whether the wheel had passed the two transducers 51 and 52 or dwelled therebetween, or the same wheel in both instances.

The arrangement of the field creating means 30 in this sensor is particularly advantageous because it enables a field to emanate from the front of the respective transducers 51 and 52 over a very narrow area. The particular arrangement produces an emanating system threshold locus which is in the shape of a cylindrical candle flame 49.

Each of the transducers 51 and 52 is identical and they are spaced apart by mounting on a base 53, with a housing 54 for electronic circuitry 50' therebetween.

Each transducer 51 and 52 comprises three cores 55, 56 and 57 of elongate cylindrical shape. The cores 55, 56 and 57 are arranged to be at right angles to one another as shown and they are held in this alignment by a spider 58. The ends of the cores 55, 56 and 57 are retained against walls of a transducer box 60 by glueing thereto. The transducer box is shown clearly by dotted lines 60 in FIG. 3. Each of the cores 55, 56 and 57 has coils wound thereon. Core 55 has a field creating coil 30 wound thereon and core 56 has a similar field creating coil 30 wound thereon. The two coils 30 are electrically connected in series as shown by the circuit diagram of FIG. 6. Core 57 has four coils wound thereon. It has a field disturbing coil 32 wound at one end near the spider 58 and coil 32 is wound over with sensor coils 33 and 34. Coils 33 and 34 can be considered as a single coil with a center tap. At the other end of core 57 is a pick-up coil 31. Coils 31 and 32 are connected in series as shown by the circuit diagram of FIG. 6.

The cores and the coils including the spider 58 are embedded in an epoxy resin moulding to provide rigidity and protection against ingress of moisture. The coils 33 and 34 are situated at a point on core 57 such that they are in a minima of the field created by the field creating coils 30. If desired the sensor coils 33 and 34 can be mounted on the core 57 to be inside of the spider 58, so they will be at the junction of the axis of the cores 55, 56 and 57. The additional field pick-up coil 31 is situated on the core 57 at a point where there will be a high field as a result of the field generated by the coils 30. With the arrangement shown a system threshold locus will emanate from the transducer 51 along the longitudinal axis of core 57 and be like a cylindrical candle flame.

The coils 30 are of equal turns and size and are spaced an equal distance from the spider 58. When coils 30 are correctly phased, and there is no wheel present, i.e. disturbing of the flux, there will be a minima in the flux at the point where the axis of cores 55, 56 and 57 intersect. Should the fields of coils 30 be moved so as to disturb this symmetry, a signal will be generated in sensor coils 33 and 34 by the method of "shifting" the minima by disturbing the field created by coils 30. The field is effectively strongest (most sensitive to disturbance) along the longitudinal axis of core 57. If coils 33 and 34 are correctly positioned and no train wheel is present there will be no signal output. With any disturbance of the field along the axis of core 57 there will be an output generated by the coils 33 and 34. Such output is proportional to the amount of field distortion caused by a train wheel. Coil 31, as previously stated, is placed in a position where there is a high field strength independent of whether there is a train wheel present or not. Accordingly, coil 31 always provides an output voltage proportional to the magnitude of the voltage source supplying coils 30. Preferably such supply voltage is an A.C. voltage at approximately 4 KHz.

Figure 6:
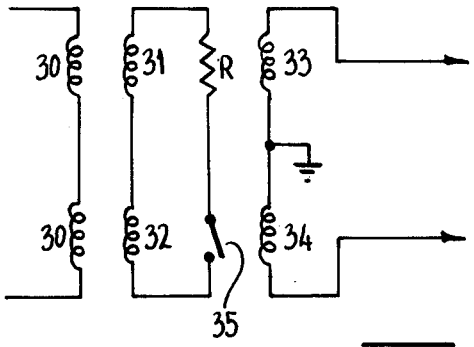
FIG. 6 is a circuit diagram of the transducer.
Figure 4:
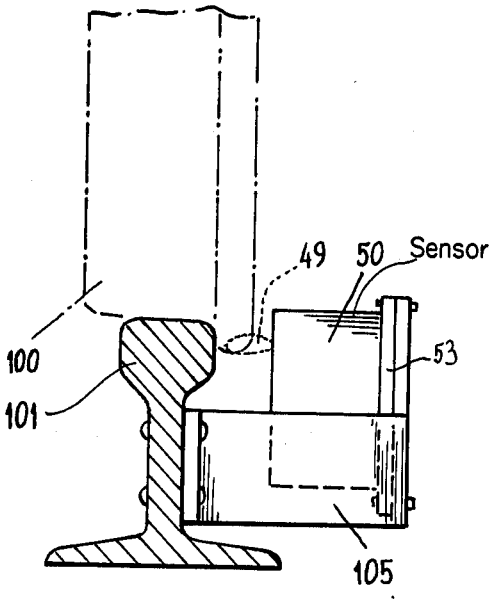
FIG. 4 is a side view of the sensor of FIG. 3 showing the manner in which it is mounted adjacent a rail for detecting the presence of a train wheel.

All coils are interconnected in the manner shown in FIG. 6 and it can be seen that coils 31 and 32 of the field disturbing means are connected in series with a resistance R and a switch 35. If switch 35 is closed and resistance R is small a flux signal (derived from the field creating means 30) is injected into the null-space and this in turn results in coils 33 and 34 providing a signal output simulating that caused by the presence of a train wheel. The magnitude of this simulated article field is a function of the value of R and may be adjusted to suit. The presence of this simulated wheel field is used to check the transducer.

The magnitude of this simulated wheel field is purposely set to provide a lower signal in the coils 33 and 34 than that which will be generated by the presence of an article such as the train wheel at a maximum required distance, along the longitudinal axis of core 57 away from the transducer. Hereinafter the level of this signal will be entitled level $\underline{\mathrm{I}}$. A signal caused by the presence of the train wheel will hereinafter be entitled level $\underline{\mathrm{II}}$ and will always be greater than that of level $\underline{\mathrm{I}}$.

Figure 5:
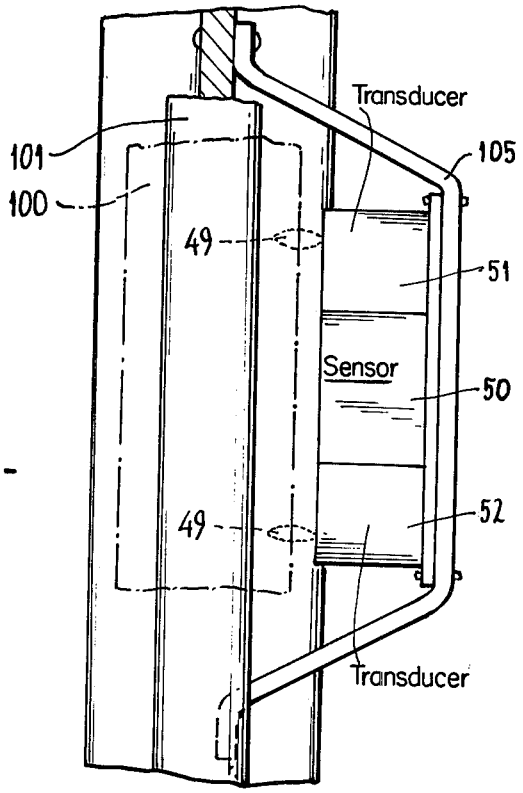
FIG. 5 is a plan view of the sensor shown in FIG. 4.

To extract unambiguous information, the train wheel has to be sufficiently close to the transducers 51 and 52 to influence the field thereof. This is achieved by mounting the sensor 50 with its base 53 fitted to a bracket 105 so that both of the transducers 51 and 52 have the flame shaped loci directed towards an edge of a rail 101 and so that a train wheel 100 can disturb those fields when it is in proximity of the respective transducers 51 and 52. The bracket 105 is of top-hat shape, as shown in FIG. 5, and is fastened to the upstanding web of the rail 101 by suitable bolts.

Figure 7:
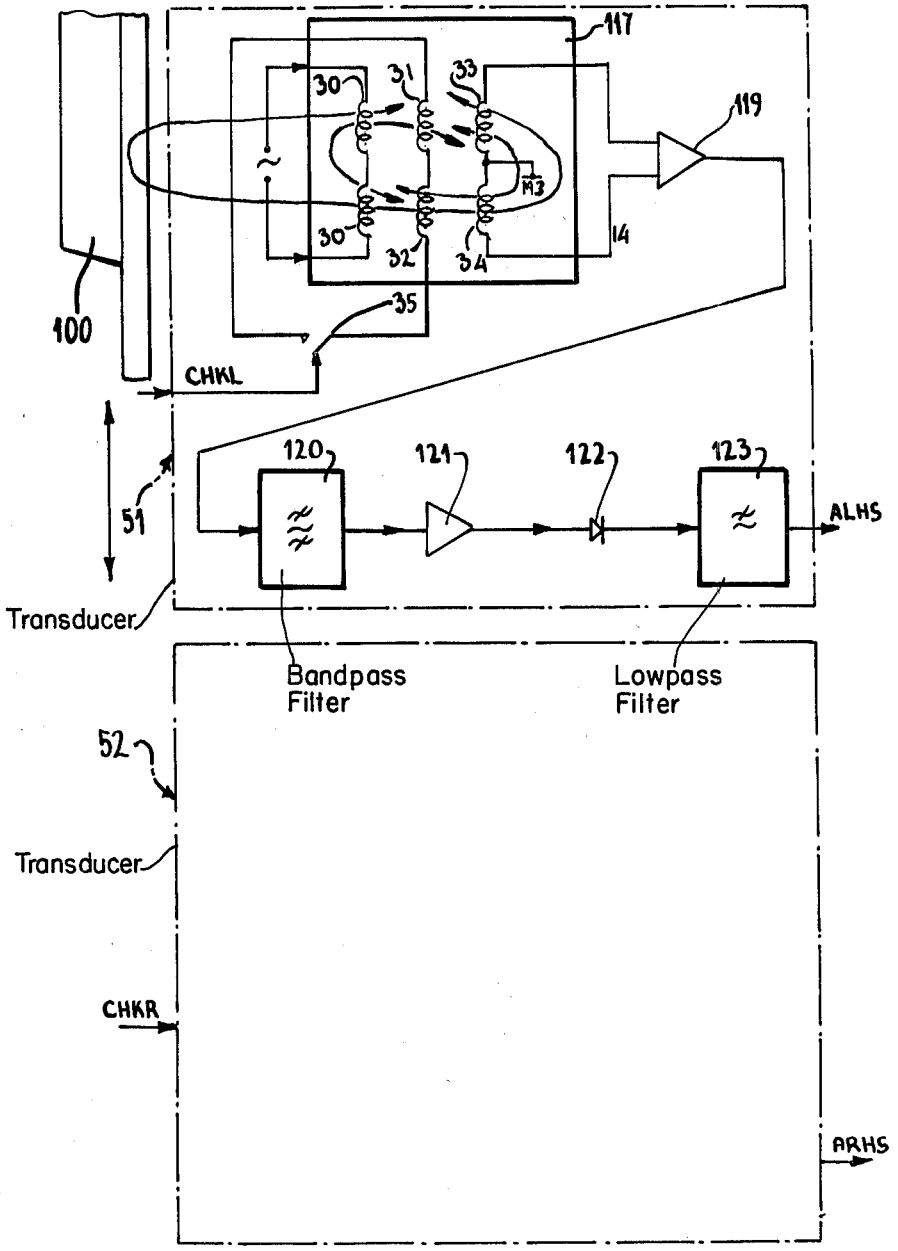
FIG. 7 is a block circuit diagram of part of electronic circuitry used in one of the transducers which make up the sensor shown in FIGS. 3 to 5.

The signal provided by the output sensing coils 33 and 34 may be subject to interference signals and accordingly it is processed in the circuit of FIG. 7 to provide a usable signal. The circuits associated with each of the transducers 51 and 52 are identical—only one being shown in FIG. 7. When the train wheel 100 is within the range of the flux emanating from transducer 51 (represented by M1 in FIG. 7) it will effect the magnetic coupling path which links with coils 33 and 34 and the resulting field produces an output voltage which is applied to a differential amplifier 119 on pins 2 and 14. The differential amplifier 119 is type (NE592N). The outputs of amplifier 119 pins 7 and 8 are applied to a band pass filter 120 which has a low frequency cut-off point at 3 KHz and a high frequency cut-off at 5 KHz. The filter signal is further amplified by applying it to differential amplifier 121 via pins 2 and 3 (NE531N). The output of which (pin 6) provides a signal suitable for detection by a diode 122 (IN914) and a filter 123 which has a low-pass characteristic with a cut-off frequency of 400 Hz. Thus, the presence of the wheel 100 affecting the field M1 will produce a stable voltage at the output of filter 123. The magnitude of this voltage will be proportional to the distance between the wheel 100 and the sensor coil 33 and 34.

The voltage level $\underline{\overline{I}}$ and level $\underline{\overline{II}}$ can be fed into logic circuitry so that level $\underline{\overline{I}}$ signals will not be processed as information other than purely checking information. As level $\underline{\overline{II}}$ signals are higher than that of level $\underline{\overline{I}}$ they will override level $\underline{\overline{I}}$ signals and be passed to subsequent circuitry to determine the wanted information concerning the train wheel.

As a train wheel passes each transducer the output signal at filter 123 will be a rising voltage which will pass through level $\underline{\overline{I}}$ before reaching level $\underline{\overline{II}}$. Thus, until it exceeds a level higher than level $\underline{\overline{I}}$ the subsequent circuitry will not be activated. To determine velocity $\overline{V}$cc of the train wheel relative to the sensor 50 the time difference between the output signals for transducers 51 and 52 as given by the Wpc and Wcc is ascertained and by knowing the spacing of the two transducers 51 and 52 the velocity can then be determined. The order in which the transducers 51 and 52 generate the output signals will determine the approach direction of the train wheel. The presence of a level $\underline{\overline{II}}$ signal will signal the presence of the train wheel.

The processing of the signals will be described later.

Reference is now made to FIGS. 8*a* to 8*e* to show the signals developed for train wheels having particular movements.

Figure 8C:
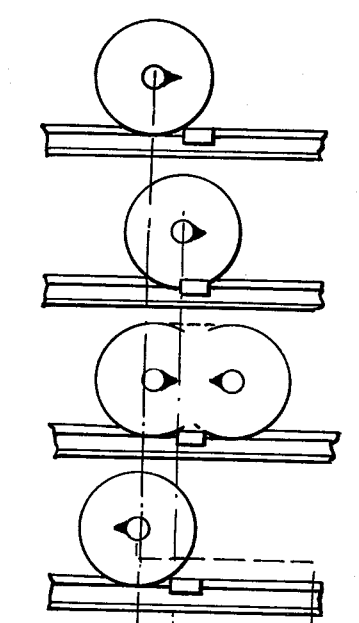
FIGS. 8*a* to 8*e* are timing diagrams showing the generation of signals representing wheel present WPC, wheel count WCC and wheel direction WDC and velocity $\overline{V}$.
Figure 8B:
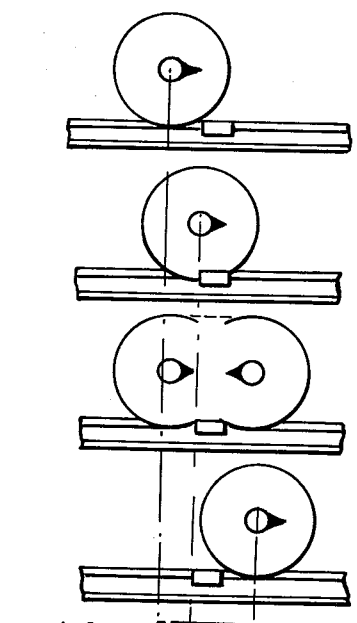
Figure 8A:
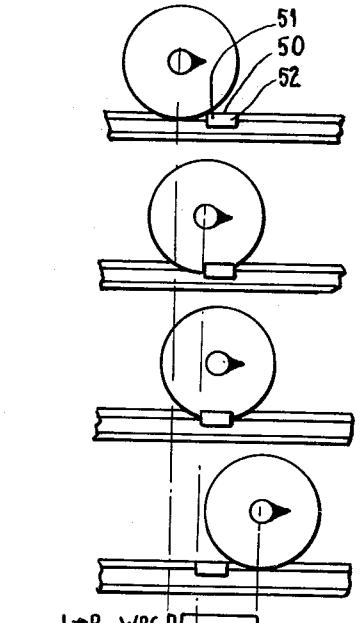
Figure 8E:
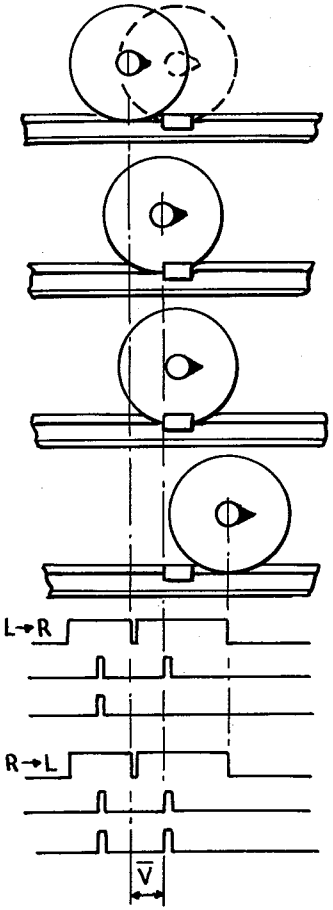
Figure 8D:
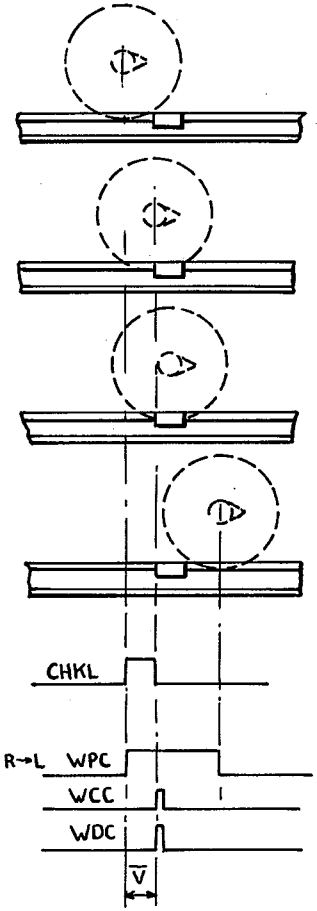
Figure 9:
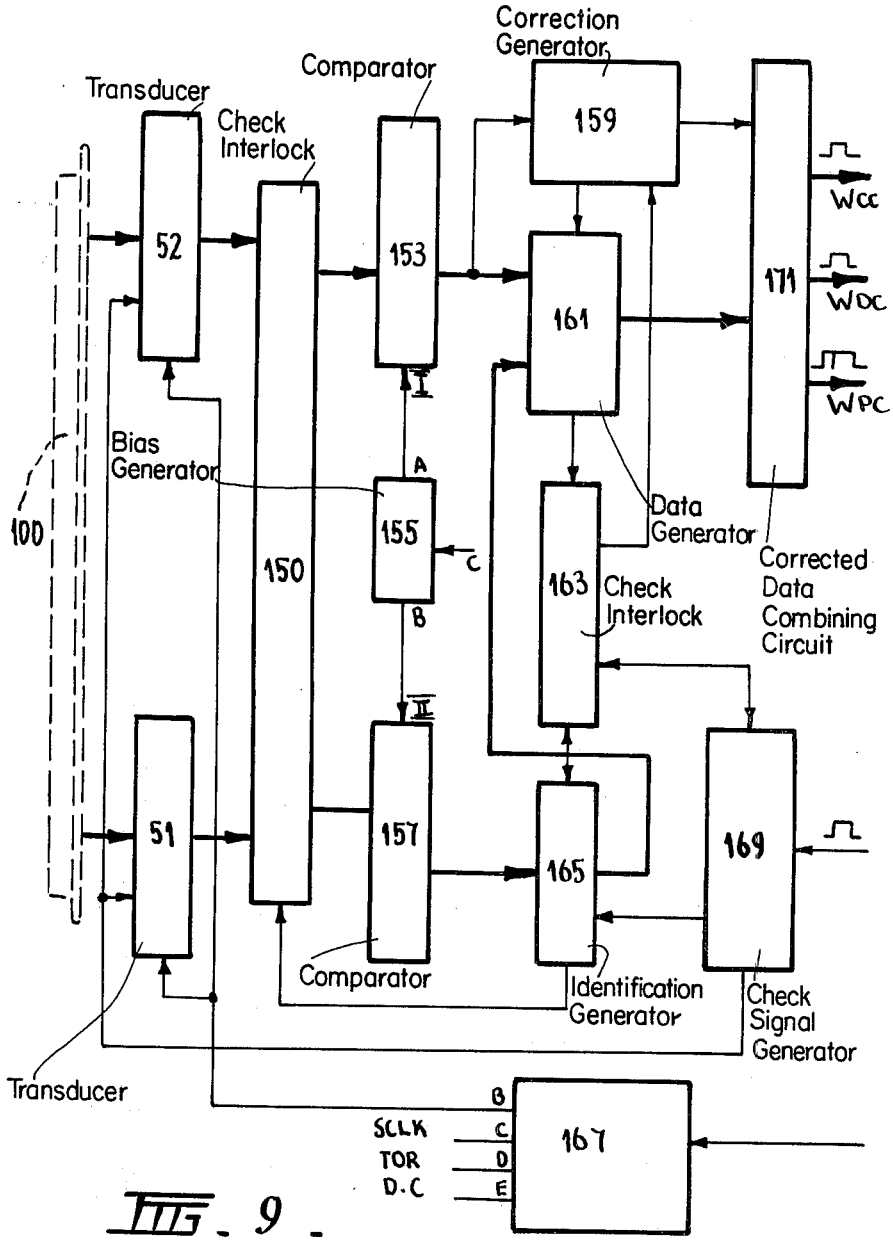
FIG. 9 is a block circuit diagram of electronics used for providing the signals used in FIGS. 8*a* to 8*c;*

FIGS. 8*a* to 8*e* show various situations of wheels passing the sensor and the various signal outputs obtained from the circuit of FIG. 9. FIG. 8*a* shows the signals developed for a through wheel. FIG. 8*b* shows signals developed when a wheel enters in one direction, dwells, and then proceeds in the same direction. FIG. 8*c* shows the signals developed for a wheel which approaches in one direction and, dwells and then reverses back out in the same direction as it approached. FIG. 8*d* shows the signals developed when a sensor is being checked by simulating the presence of a wheel when a level $\underline{\overline{I}}$ signal is developed.

FIG. 8*e* shows the signals developed when a real-wheel approaches the transducer, when a check is in progress.

The various signals shown in FIGS. 8*a* to 8*e* are shown when the wheel approaches from left to right (L-R) and those developed when the wheel approaches right to left (R-L).

The respective signals WP, WC and WD represent:

WPC=wheel presence

WCC=wheel count

WDC=wheel direction.

Velocity is determined from the time interval between the start of wheel presence signal and the start of the wheel count signal.

It will be noted from FIG. 8*d* that the check signal is chosen as moving right to left in order to include all components and external wiring in the check.

SENSOR 50 BLOCK DIAGRAM - FIG. 9

| ITEM | DESCRIPTION |
|---|---|
| 100 | Wheel. |
| 51 | Left-hand side transducer including amplifier. |
| 52 | Right-hand side transducer including amplifier. |
| 150 | Check interlock 1. |
| 153 | Level $\underline{\overline{I}}$ comparator and logic signal generator. |
| 155 | Level $\underline{\overline{I}}$ and level $\underline{\overline{II}}$ bias level generator (part of power supply). (a) Level $\underline{\overline{I}}$ (b) Level $\underline{\overline{II}}$. |
| 157 | Level $\underline{\overline{II}}$ comparator and logic signal generator. |
| 159 | Wheel count correction generator. |
| 161 | Wheel count (Wc), Wheel direction (Wd) and Wheel presence (Wp) generator. |
| 163 | Check interlock 2. |
| 165 | Real-train address generator (signature). |
| 167 | Power supply providing, (B) field excitation, (C) System Clock - SCLK (D) TOR (turn on reset), (E) DC power for all devices. |
| 169 | Check signal generator. |
| 171 | Corrected Wp, Wc, Wd combining circiut. |

Both transducers 51 and 52 will respond as described previously so that if the wheel 100 disturbs the field of both of them they will both provide outputs from their respective filters 123. Similarly, if a check is in progress and one transducer 51 or 52 is active and a wheel 100 arrives at the other transducer a false operation could occur if an interlock was not incorporated. This interlock "check interlock I" 150 ensures that the transducer not operated by the wheel 100 will be discharged to its quiescent level on entry of the wheel. This interlock 150 is only active during check conditions and will be discussed later since it is otherwise transparent to signals.

Figure 10:
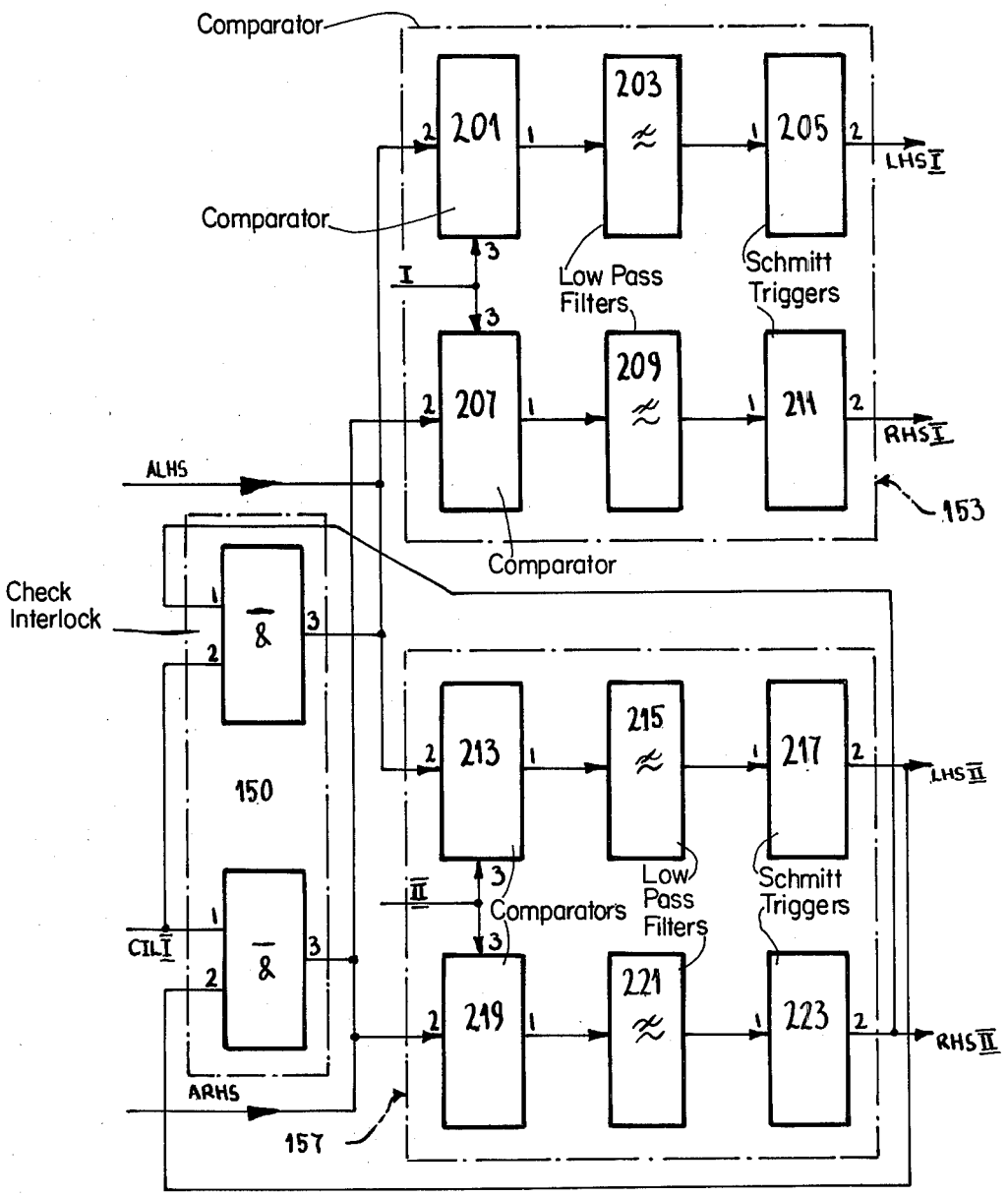
FIGS. 10 to 19 show respectively details of the various blocks shown in FIG. 9.

Reference is now made to FIG. 10. The output of the LHS transducer 52 ALHS is applied to the input pin 2 of comparator 201 (MC1558N) which compares the signal level with that of the reference bias level $\underline{\overline{I}}$ at pin 3. If the signal is less than the reference the output from pin 1 is at a logical low; if it is higher than the reference the output switches to a logical high. This signal is filtered by a low pass filter with a cut-off frequency of 35 KHz and then applied to pin 1 of a Schmitt trigger amplifier 205 (MC14584BCP). The output from pin 2 of the amplifier 205 is then a logical level signal LHSI which is applied to subsequent circuitry. The comparator 201 is used to decide if the output of filter 123 has reached level $\underline{\overline{I}}$. If the output of filter 123 is at the quiescent level then the output of amplifier 205 is at a logical low. If the output of filter 123 is at level $\underline{\overline{I}}$ then the output of amplifier 205 is at a logical high. Similarly, the corresponding output of the RHS transducer ARHS is applied to pin 2 of comparator 207 (MC1558N) through a low pass filter 209 and through the Schmitt trigger amplifier 211. The logical level of pin 2 of amplifier 211 will thus indicate if the voltage level at the RHS transducer 51 is above or below level $\underline{I}$. The outputs of the LHS 52 and RHS 51 transducers are also applied to a second identical set of comparators filters and Schmitts 213–223. These generate the logical signals related to level $\underline{II}$. A voltage level equivalent to level $\underline{II}$ at the output of filter 123 will produce a logical high at output pin 2 of amplifier 217 and similarly at pin 2 of amplifier for a level $\underline{II}$ signal at the output of item 51. The level $\underline{I}$ and level $\underline{II}$ voltages for the comparators 201, 207, 213 and 219 are obtained from bias level generator 155 by known biasing techniques. Four logical signals have thus been produced indicating whether the LHS or RHS 51 and 52 transducers are active and at which level, $\underline{I}$, $\underline{II}$ or quiescent.

These signals are then processed in order to produce the required output signals from the transducer.

Figure 11:
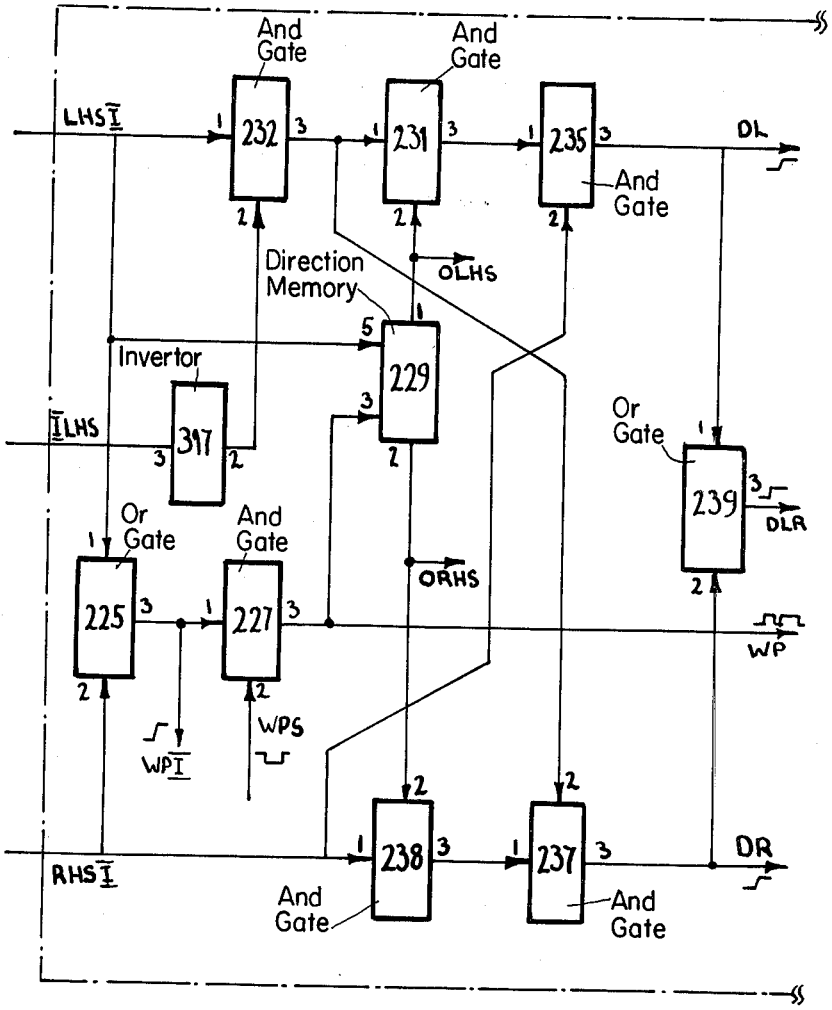
Figure 12:
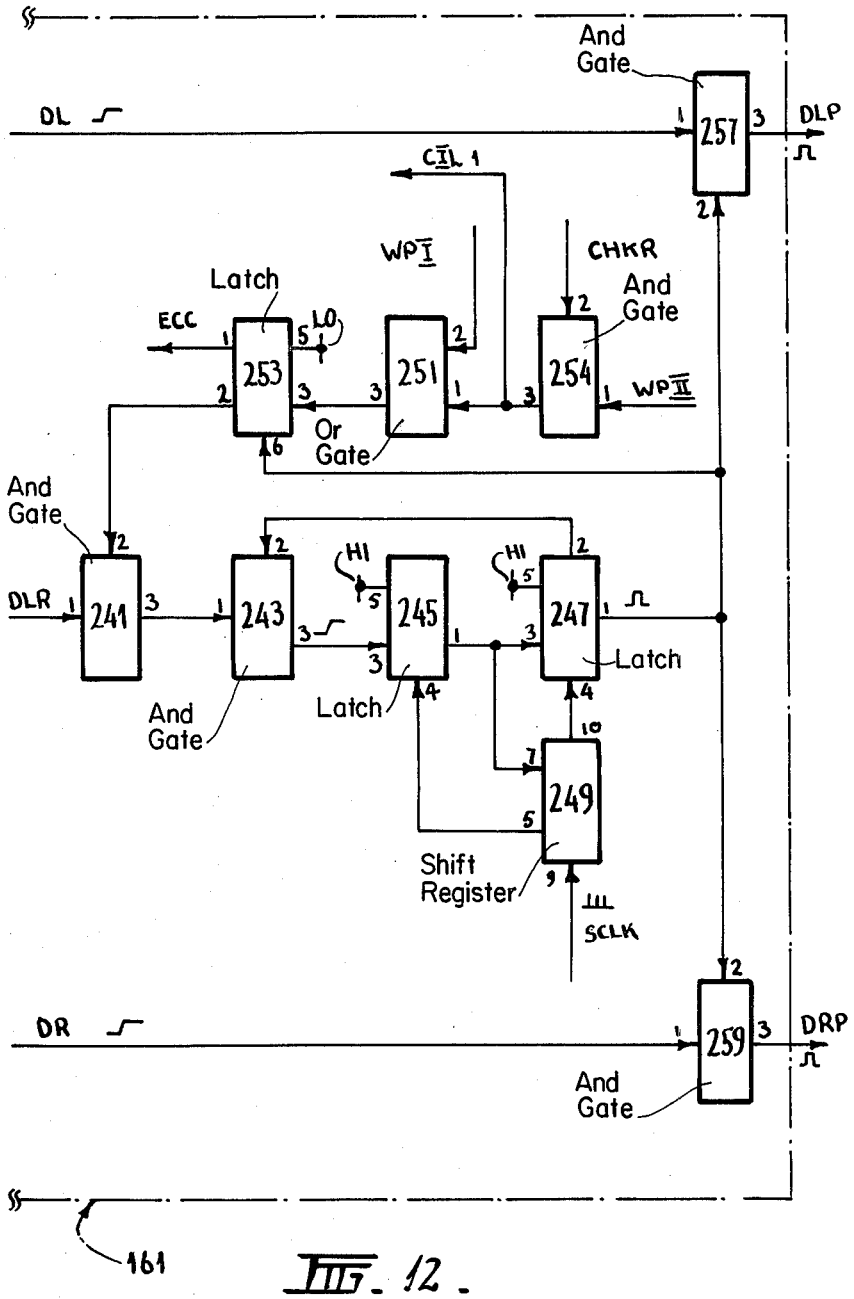
Figure 13:
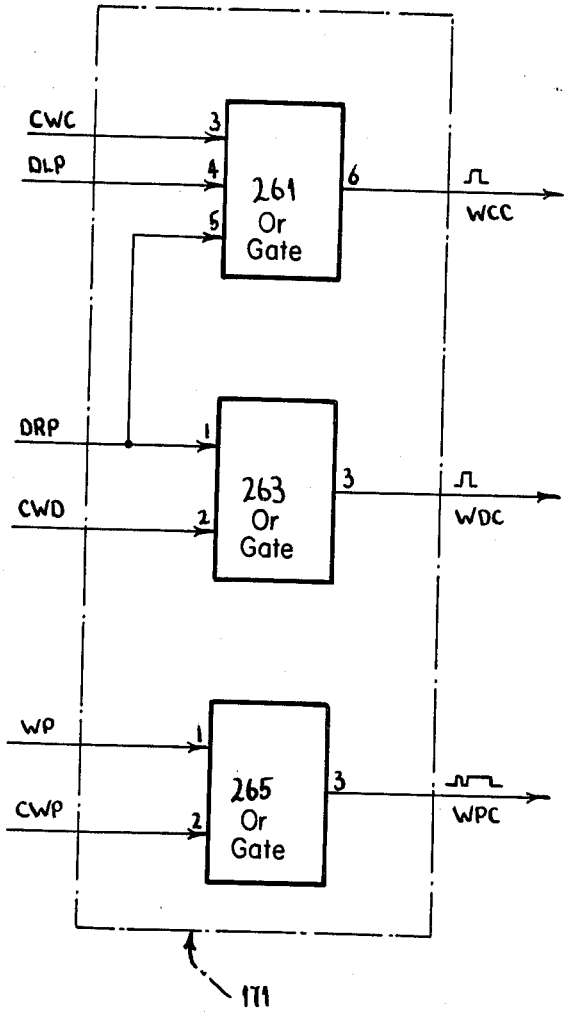
Figure 14:
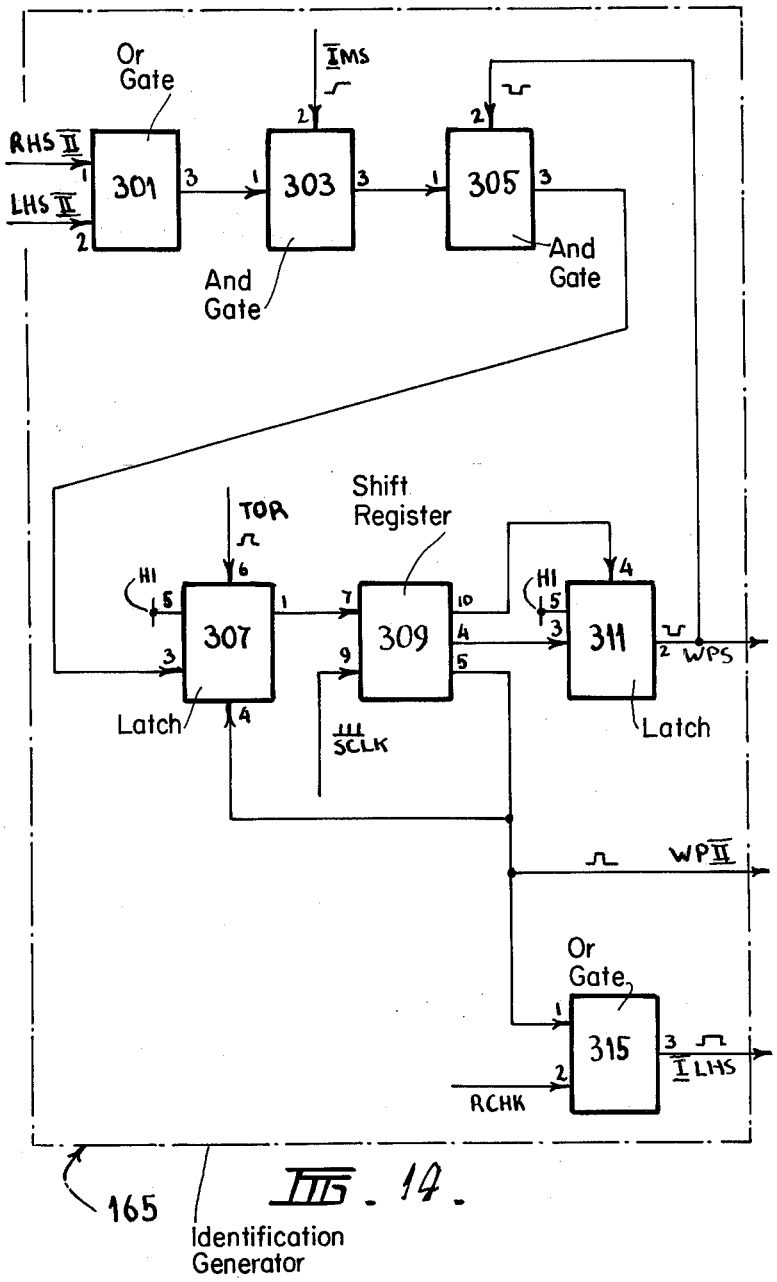
Figure 15:
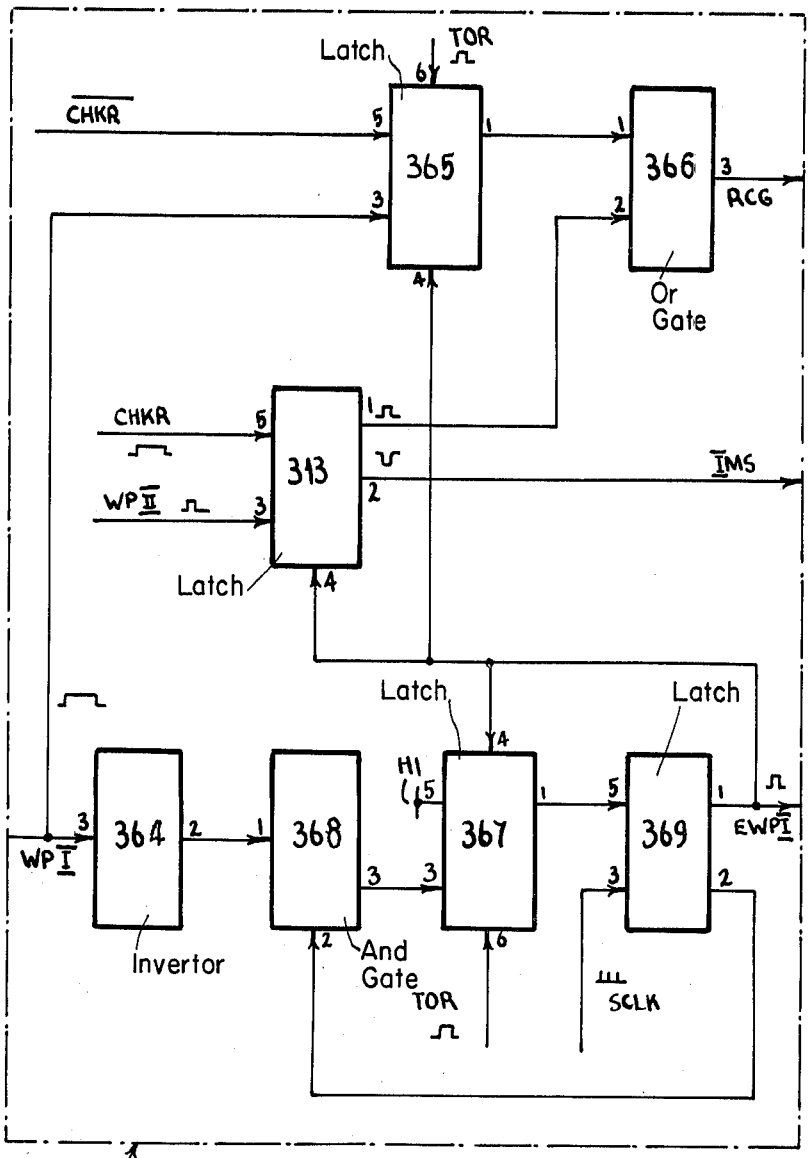
Figure 16:
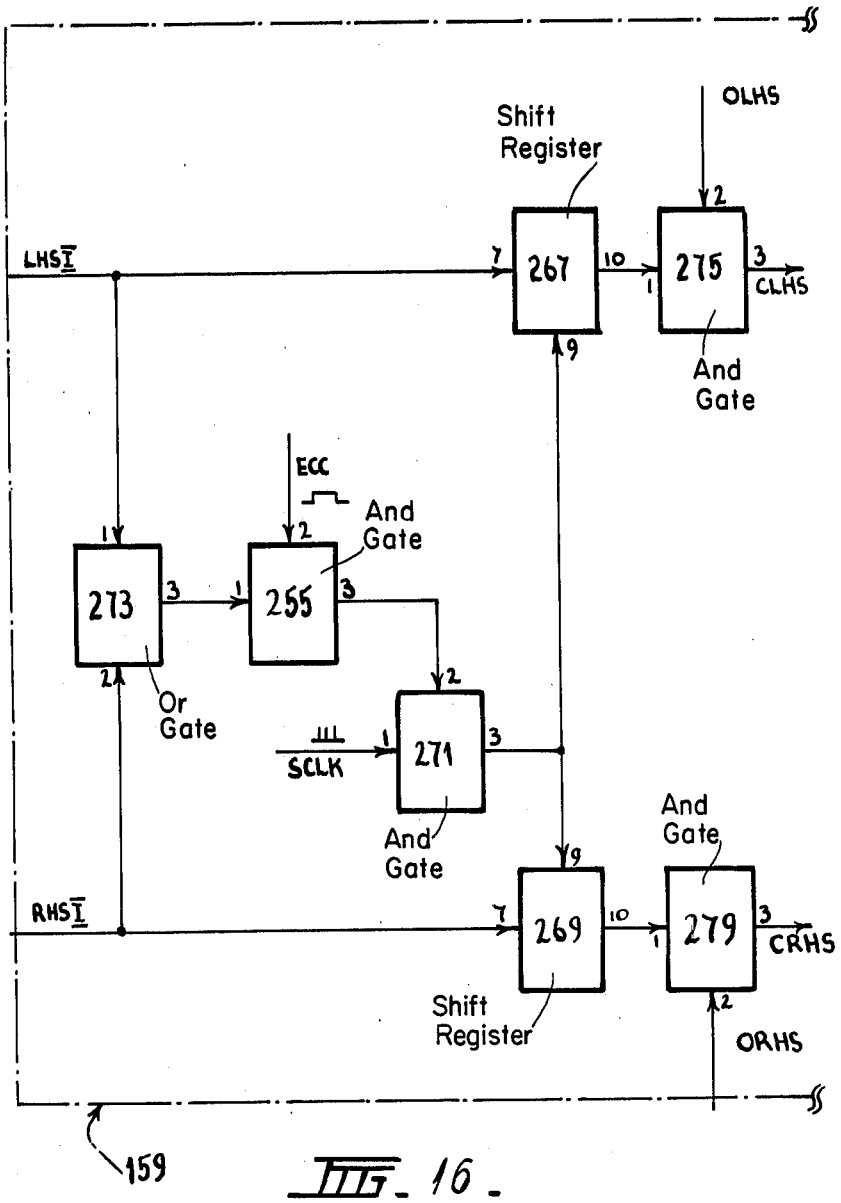
Figure 17:
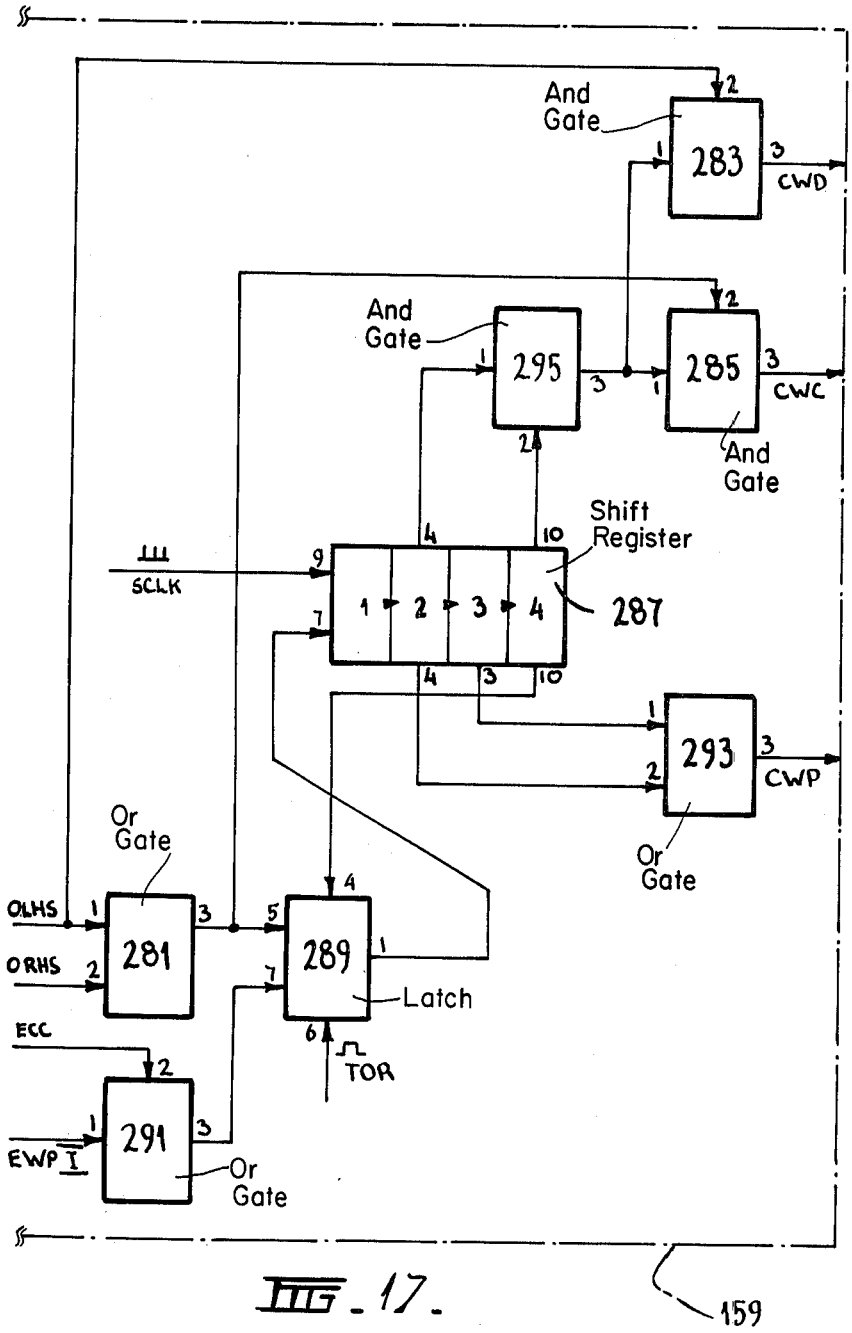

Reference is now made to FIG. 11. A WP$\underline{I}$ (wheel present level $\underline{I}$) signal is obtained by combining the LHS and RHS level $\underline{I}$ signals. Pin 2 of amplifier 205 is applied to pin 1 of an OR gate 225 (MC140718CP) and pin 2 of amplifier 211 is applied to pin 2 of gate 225. The resultant signal which indicates if a wheel (assuming the output of amplifiers 223 and 217 are at a logical low) is just entering the transducer field appears at pin 3 of gate 225 and is applied to an inhibit AND gate 227 (MC14081BCP) at pin 1. A control signal is obtained from pulse generator 311 at pin 2 (refer to FIG. 14 (to be described later)) and would be at a logical high if level $\underline{II}$ is not active. The output from pin 3 of gate 227 is passed from the sensor 50 as the Wpc (wheel present) signal via the combining circuit 171 (see FIG. 9). This signal will also clock a direction memory 229 (MC14013BCP) being applied at pin 3 and so transfer the logical signal at pin 5 to pin 1. The signal applied to pin 5 of memory 229 is the LHS level $\underline{I}$ logic signal from pin 2 of comparator 207 LHSI. This signal will be at a logical high if the wheel 100 entered from the left and at a logical low if the wheel 100 entered from the right at the time of clocking. An inverted memory output appears at pin 2 of memory 229 thus a wheel 100 entering left forces pin 1 high and a wheel 100 entering right forces pin 2 high. Pin 1 of memory 229 is then applied to the control input of an enable AND gate 231 (MC14081BCP) pin 2 which is at a logical high and will allow data to pass from pin 1 to pin 3 of gate 231. The data applied to pin 1 of gate 231 is the LHS level $\underline{I}$ signal LHSI providing that it is not inhibited by gate 232 (MC14081BCP). Gate 232 is part of an interlock circuit used during check conditions and is otherwise transparent. The output pin 3 of gate 231 applied to a second enable AND gate 235 (MC14081BCP) pin 1 which has applied to its control pin 2 the RHS level $\underline{I}$ (RHS$\underline{I}$) signal from amplifier 211 pin 2. Thus, if a wheel enters left memory 229 pin 1, gate 232 pin 3, gate 231 pin 3 are set high. When the wheel 100 reaches the RHS transducer 52 gate 235 pin 2 goes high and the data is transmitted through gate 235 to pin 3. DL equals direction Left. A similar set of events occurs when a wheel arrives from the right and gate 237 pin 3 goes to a logical high when the LHS transducer 51 is reached by appropriate operation of gate 238. Both signals are combined in an OR gate 239 (MC14071BCP) pin 3 gate 237 being connected to pin 2 and pin 3 of gate 235 to pin 1. The output pin 3 gate 239 will switch to logical high when the wheel 100 reaches the second transducer irrespective of the direction of motion. The output from pin 3 of gate 239 passes through two AND inhibit gates 241 and 243 (MC14081BCP) which are at this time transparent (refer to FIG. 12). The signal is passed directly to pin 3 of latch 245 (MC14013BCP) which since pin 5 is held high causes a high to be transferred to latch 245 pin 1 which similarly transfers a high to pin 3 of latch 247 (MC14013BCP). The output of gate 245 is also applied to pin 7 of a shift register 249 (MC14015BCP). The data appearing on pin 7 is clocked in by the system clock SCLK applied at pin 9. After the first subsequent system clock pulse the QO output at pin 5 goes high and resets gate 245 at pin 4. The data is propagated through the register 249 until the final output pin 10 switches high which resets gate 247 at pin 4. Thus a pulse is formed at pin 1 of gate 247 which is between 3 and 4 system clock periods long and is triggered when the second transducer becomes active. In order to inhibit incorrect triggering of the monostable multivibrator comprising items 245, 247 and 249 gates 241 and 243 are employed. Gate 243 ensures that latch 245 is only clocked once during each output pulse. The signal at pin 2 of latch 247 is applied to the control pin 2 of the inhibit gate 243 and inhibits data transfer for the duration of the pulse. Gate 241 ensures that the monostable multivibrator only triggers once after the first transducer 52 becomes active. The WP$\underline{I}$ (wheel presence level $\underline{I}$) signal from gate 225 pin 3 is applied via an OR gate 251 (MC14071BCP) pin 2 and 3 to pin 3 of "D" type latch 253 (MC14013BCP) where it transfers the low at pin 5 to pin 1 and a high to pin 2 thus causing gate 241 to be transparent as described above. Once the monostable multivibrator has been triggered pin 1 of gate 247 will be high for the pulse duration and this signal sets gate 253 at pin 6 causing pin 2 to go low and thus inhibit any further data passage from pins 1 to 3 of gate 241 until the start of the next WP$\underline{I}$ signal. The alternative enable applied to pin 1 of gate 251 is derived from the output of gate 254 pin 3. This enable is only active under check conditions. A WP$\underline{II}$ (wheel present level $\underline{II}$ signal to be discussed later) from pulse generator 309 pin 5 (see FIG. 14) is applied to the enable AND gate 254 (MC14081BCP) pin 1 and a check Right CHKR signal from gate 347 pin 3 (see later FIG. 18) applied to the control input pin 2. If the CHKR signal is active and then the WP$\underline{II}$ signal occurs it will be transmitted through gates 25 and 251 to clock latch 253 and therefore enable gate 241 in a similar fashion to WP$\underline{I}$ above. The pulse output from gate 247 pin 1 is applied to the two AND enable gates 259 and 257 (MC14081BCP) so allowing the data present on pin 1 to be transferred to pin 3 for the duration of the pulse. A direction pulse is thus obtained at the output of gates 259 and 257 direction Right pulse DRP and direction Left pulse DLP respectively. If the train entered left, a pulse will appear at the output of gate 257 and at gate 259 if it entered right, the pulse only occurring in either case if both transducers 51 and 52 were activated. Gate 253 is also used to enable the count correction generator 159 (see FIG. 9). The signal at pin 1 of gate 253 will switch to a logical low on the occurrance of a WP$\underline{I}$ signal, i.e. the inverse of pin 2 described above and then switch to a logical high if the wheel 100 activates both transducers 51 and 52 and therefore causes a pulse to be produced by latch 247 at pin 1. The count correction generator 159 is enabled once this pulse has been produced by the signal at gate 253 pin 1 ECC (Enable Count Correction) by applying it to gate 255 pin 2 FIG. 16 to be discussed later. The outputs from gates 259 and 257 provide the wheel directional information but on two lines. These are combined in the combining circuit 171 (refer to FIG. 13) to give direction information on a single line together with wheel count information on a single line. The output of gate 254 pin 3 DLP is connected to an OR gate 261 Pin 4 (MC14071BCP) and gate 259 Pin 3 DRP to gate 261 at pin 5 so that whichever direction the wheel 100 arrives when it reaches the second transducer 51 a pulse always occurs at the output of gate 261 pin 6. This is known as the wheel count pulse WCC. The DRP signal is also applied to gate 263 pin 1 and therefore producing a pulse at pin 3 if the wheel 100 entered right but not if it entered left. Thus a pulse on the Wc line indicates a through train and a coincident pulse on the wheel direction line WDC 263 pin 3 indicates that the train entered right. If the WDC pulse is absent coincident with a WCC pulse then the train entered left. A train that enters the second transducer active area causes WCC and WDC information to be transmitted. If it ceases motion and reverses before clearing the active area and then leaves in the direction from which it came it will have caused erroneous information to be transmitted. In order to correct this a count correction generator 159 is incorporated. This circuit determines if the information was in error and produces suitable pulses to negate that information. If the first information was a WCC and WDC pulse then on leaving the sensor a WCC without WDC would be generated. This would enable any monitoring device to correct its record of transactions. The additional information appears in a known time and in a known duration after the wheel 100 leaves the sensor 50. The duration of the information is short so that it cannot interfere with the next wheel 100 within the speed limitations of the sensor 50. A correction Wc pulse "CWC" if produced by correction generator 159 is applied to gate 261 pin 3 and is combined onto the pin 6 line providing the resultant sensor signal wheel count corrected "WCC". Similarly corrected Wd is applied to gate 263 pin 2 and the resultant signal at pin 3 is the wheel direction signal corrected "WDC". In order that the correction signals appear otherwise normal, ie. for noise immunity, a corrected wheel presence CWP signal is produced and combined via gate 265 pin 2 to pin 3 to give the wheel presence corrected WPC signal. It is these three signals WCC, WDC and WPC that contain the information produced by the sensor 50. FIGS. 16 and 17 describe the count correction generator 159. The output of the LHS level $\overline{1}$ logic signal generator amplifier 205 pin 2 is applied as data to the shift register 267 (MC14015BCP) on pin 7 and similarly RHSI to shift register 269 (MC14015BCP). These two registers are clocked by the signal from an AND enable gate 271 (MC14081BCP) pin 3. If pin 3, connected to pin 9 of registers 267 and 269 is active then the data present on registers 267 pin 7 and 269 pin 7 is shifted into the registers. Amplifier 205 pin 2 is also connected to gate 273 pin 1 and similarly amplifier 211 pin 2 to gate 273 pin 2 so that whichever transducer 51 or 52 is active as the wheel 100 is leaving the sensor 50 will cause gate 273 pin 3 to be at a logical high. The signal is applied to gate 275 pin 1 and AND enable gate (MC14081BCP) and is transferred to pin 3 by the signal enable count correction "ECC" when present at pin 2. The ECC signal will only occur as already discussed if the wheel 100 has caused both transducers 51 and 52 to be active and a Wc has been transmitted. If Wc has not been transmitted a complete transaction has not occurred and a correction is not necessary. If "ECC" is active then a logical high will be transferred from gate 273 pin 3 another AND enable gate 271 (MC14081BCP) which allows the system clock "SCLK" to be transferred from pin 1 to pin 3 and thus to register 269 pin 9 and register 267 pin 9. The data indicating the exit direction of the wheel 100 is thus stored in registers 267 and 269. This is true even if the wheel 100 jitters to and fro between the transducers 51 and 52 assuming WP$\overline{I}$ remains active. When the wheel 100 finally exits and WP$\overline{I}$ is at logical low then gates 273 pin 3, 255 pin 1, 255 pin 3, 271 pin 2 and 271 pin 3 are also low and so capturing the final information in gates 267 and 269. This information is then compared by applying it to enable gates 275 and 279 (both MC14081BCP) with the original transaction information stored in the direction memory 229 (FIG. 11). The control signal of gate 279 pin 2 is joined to memory 229 pin 2 original RHS signal "ORHS" and that of gate 275 pin 2 to "OLHS" memory 229 pin 1. If the original active signal was on memory 229 pin 1 then the information stored in gate 267 pin 10 is applied to an OR gate 281 pin 1 (MC14071BCP) and an AND enable gate 283 pin 2 (MC14081BCP). However, if memory 229 pin 2 is the active pin then the data at gate 269 pin 10 is applied to gate 281 pin 2. Refer to FIG. 17. Gate 283 is only enabled and therefore produces a Wd pulse if OLHS is active and the data stored in gate 267 is active ie. the train both enters from exits to the left. Gate 285 (MC140818CP) is enabled and thus produces a Wc pulse if the train exits in an opposite direction to its entry ie. if gates 267 pin 10 and OLHS or gate 269 pin 10 and ORHS are active then gate 281 pin 3 becomes active and gate 285 is enabled at pin 2. Timing of the CWc, CWd and CWp correction pulses is controlled by shift register 287 (MC14015BCP) which is in turn enabled by gate 289. A wheel 100 which enters the field of both transducers 51 and 52 will cause a Wc pulse to be transmitted, an ECC signal will occur at gate 253 pin 1 FIG. 12 and this is applied to the control pin of an AND enable gate 291 (MC14081BCP) pin 2. The data applied to pin 1 of gate 291 is the end of WP$\overline{I}$ signal EWP$\overline{I}$ generated by the monostables 367, 369 at Pin 1. See FIG. 15. Thus when EWP$\overline{I}$ is generated by the wheel 100 leaving the sensor 50 it is transmitted from gate 291 pin 1 to pin 3 and so to pin 7 of gate 289 a "D" type bistable multivibrator (MC14013BCP). The combination of ECC and EWP$\overline{I}$ in gate 291 provides a signal indicating that corrective information may be required. The signal gate 281 pin 3 indicates if the wheel 100 reversed direction. By combining and remembering these signals in gate 289 an instruction to transmit signal is obtained at pin 1 thereof by the signal at pin 7 clocking that at pin 5 to the output pin 1 and hence to pin 7 of shift register 287. The system clock SCLK is applied to pin 9 and will clock through the data occurring at pin 7.

The first clock pulse after the occurrence of EWP$\overline{I}$ will cause the first register output to switch high. The second will cause the second output pin 4 to be high which is applied to an OR gate 293 (MC14071BCP) pin 2 causing pin 3 to go high and produce the start of the CWP signal. Thus the start of CWP occurs 1 to 2 clock pulses after EWP$\overline{I}$. The fourth clock pulse will cause pin 10 to go high which is applied to the reset pin 4 of gate 289 causing pin 1 and register 287 pin 7 to go low. Register 287 pin 3 will remain high for a further 3 clock pulses and since the Data pin 7 is low will then go low. The output pin 3 is applied to gate 293 pin 1 and will hold pin 3 high when register 287 pin 3 is high. Thus CWP will be high for 6 clock pulses. The timing of CWD and CWC is organized so that they fall within the period of CWP. Pin 4 of register 287 is connected to an AND enable gate 295 (MC14081BCP) pin 1 which is controlled at pin 2 by register 287 pin 10. Thus the pulse at gate 295 pin 3 will go high on the fourth clock after EWP$\overline{\text{I}}$ and low again on the seventh. This signal is applied as data to two AND enable gates 283 and 285 at pins 1 (MC14081BCP). The control signal applied at pin 2 of gate 285 is the output of gate 281 pin 3 and is the signal which indicates if a CWC is required and enabling if active the pulse at register 287 pin 10 to appear at gate 285 pin 3. Similarly the signal at gate 275 pin 3 which indicates if a CWD signal is required is applied to gate 283 pin 2 and enables the pulse at pin 1 to appear at pin 3. The outputs of gate 283 pin 3, gate 285 pin 3 and gate 293 pin 3 are applied in combining circuit 171 to gate 263 pin 2, gate 261 pin 3 and gate 265 pin 2 respectively. The operation of combining circuit 171 has already been described.

The circuit as described copes with the different movements of a wheel in the active area of the sensor 50. In order that the system may be checked an additional level of information is required so that a signal caused by a wheel 100 may be differentiated from a check signal and thus enable the real wheel 100 signal to have priority. This additional information is generated by circuit 165 FIGS. 9 and 14—the real train identification generator. The output of amplifier 217 pin 2 is applied to an OR gate 301 (MC14071BCP) (see FIG. 14) at pin 2 and similarly amplifier 223 pin 2 to gate 301 pin 1. A wheel 100 which enters the active area of one of the transducers 51 or 52 will first cause LHSI or RHSI to become active. When the wheel 100 penetrates further into the active region it will cause either amplifier 217 pin 2 or amplifier 223 pin 2 to go high as already discussed. Either LHS$\overline{\text{II}}$ and RHS$\overline{\text{II}}$ active will cause gate 301 pin 3 to go high. This signal is applied via the two AND inhibit gates (MC14081BCP) 303 and 305 which are at this time transparent to pin 3 of latch 307 (MC14013BCP) a "D" type. Circuits 307, 309 and 311 form a pulse generator with outputs wheel presence signature and wheel presence level $\overline{\text{II}}$. The positive edge occurring at pin 3 of latch 307 transfers the high at pin 5 to the output pin 1 which then acts as data for the shift register 309 (MC14015BCP) at pin 7. SCLK is applied to pin 9 of register 309 and clocks the data through. The first clock pulse causes pin 5 QO to go high which is used to reset latch 307 by being applied at the reset pin 4. The data at pin 7 latch 307 goes low and a pulse one clock pulse wide is propagated through the register 309. The pulse so obtained at pin 5 of gate 309, WP$\overline{\text{II}}$ indicates that a wheel 100 is passing the sensor 50. A check signal would not on its own cause a WP$\overline{\text{II}}$ signal to be generated. The second clock pulse after level $\overline{\text{II}}$ becoming active forces register 309 pin 4 high the positive edge of which because of the high at pin 5 of gate 311 will set pin 2 low. The fourth clock pulse will set register pin 10 high and reset gate 311 pin 4 thus forcing pin 2 high. A pulse is therefore formed at gate 311 pin 2 which is two clock pulses in duration and occurs one to two clock pulses after gate 301 pin 3 goes high. The pulse from gate 311 pin 2 is applied to control pin 2 of the enable gate 305 and disables further signals propagating from gate 305 pin 1 to pin 3 for the duration of the pulse. The gate 305 is otherwise transparent as assumed above. If the check signal CHKR is active and a wheel 100 occurs then an inhibit signature signal "IMS" is generated by gate 313 (MC14013BCP) at pin 2. This pulse is applied to gate 303 pin 2 as a control signal and would be normally high thus making the path from pin 1 to pin 3 transparent. If a WP$\overline{\text{II}}$ signal occurs when a check is in progress the gate 303 pin 2 is forced low and the path at pin 1 is inhibited until gate 313 is reset by EWP$\overline{\text{I}}$. This ensures that only one WPS pulse is produced following a check signal. The WPS signal is applied to gate 227 (FIG. 11) pin 2 as a control signal and will cause a negative pulse to occur in the positive WP$\overline{\text{I}}$ pulse. Also this pulse will be of 2 clock pulses and between 1 and 2 clock pulses after the wheel 100 reaches the sensor 50 level $\overline{\text{II}}$ active area. Since a check signal does not operate level $\overline{\text{II}}$ the WPS pulse will not be present in WPC unless a real wheel enters the active region of the sensor 50. If a wheel 100 arrives during a check phase then WPS will occur and be incorporated into WPC as described above. Thus the presence or absence of WPS in WPC enables a sensor monitoring device to determine if the sensor 50 is responding to a wheel or a check signal. Gate 315 is an interlock which together with invertor gate 317 (FIG. 11) and gate 232 ensure that erroneous "Wc" signals do not occur if a wheel 100 arrives during a check phase. "WP$\overline{\text{II}}$" from gate 309 pin 5 is combined in an OR gate 315 (MC14071BCP) with a reconstituted check "RCHK" signal from gate 347 pin 3 FIG. 18.

The output of gate 315 pin 3 is the inhibit left hand side signal ILHS which is applied to an inverter gate 317 (MC14049BCP) at pin 3. The resultant signal at pin 2 is applied to the control input of the inhibit gate 232. The path gate 232 pin 1 to pin 3 is thus transparent unless the ILHS signal occurs.

The sensor 50 is checked by applying a check signal at pin 1 of the inhibit AND gate 230 (MC14081BCP). This is the input to the check signal generator 169 refer FIGS. 18 and 19. This circuit generates signals which activate switch 35 (refer FIG. 7) and the corresponding switch in the other transducer in a manner which simulates the passage of a wheel. A signal is generated which activates the right transducer 52 then the left transducer 51. The right transducer 52 alone is active for the duration of the input check signal then both transducers 51 and 52 are active for the same period before the generator signals cease. Gate 230 is initially transparent and the applied check signal is transmitted to the control pin 2 of a second enable gate 331 (MC14081BCP) which causes the SCLK signal applied at pin 1 to propagate to pin 1 of OR gate 333 (MC14071BCP) where it forces SCLK to appear at pin 3 thereof (CCL) and so be applied to the clock input of the 16 stage binary counter comprising circuits 335, 337, 339, 341 (MC14516BCP). The logical high of the CHK signal from gate 230 pin 3 is also applied to the up/down control inputs of the counters 335, 337, 339, 341 pins 10. This causes the counter under the control of SCLK to count UP from Zero. The outputs of the counter are decoded by a 16 input OR gate comprising gates 343 and 345 NOR gates (MC14078BCP) and NAND gate 347 (MC14011BCP). The output of the OR gate appears at pin 3 of gate 347 and is at a logical low only if the counter is at zero. This is only true if check is not active. Pin 3 will be a logical high for the period that the check input is applied and also for the similar time that the counter takes to count down to zero. The output from OR gate 343 pin 3 is the check right transducer signal "CHKR" and is applied to the control pin of switch 35 in the right hand transducer (not shown in FIG. 7). On operation it produces a level $\overline{I}$ signal at the output as signal ARHS. Termination of the CHK signal forces the counter U.D. signal to go low and cause the counter to count down when clocked. The up clock from gate 331 pin 3 ceases when pin 2 is low but the "UD" signal is also applied to the inverter 350 (MC14049BCP) pin 3 with the output pin 2 passing through the transparent enable AND gate item 351 (MC14081BCP) and enabling AND gate 353 (MC14081BCP) at control pin 2. Thus the system clock applied to gate 353 pin 1 will propagate to pin 3, pass via gate 333 and again clock the counter. Gate 351 is controlled at pin 2 by the output pin 1 of gate 355 (MC14013BCP). The system clock is inverted by gate 357 (MC14049BCP) and applied to the clock input of gate 355 pin 3 where it will transfer the logical high at pin 5 caused by CHKR to gate 355 pin 1 and enable gate 351 as assumed above. The termination of the CHK signal causes a positive transition to occur at the output of gate 350 pin 2. This is the enable check left signal "ECL" which is applied to pin 7 of latch 359 (MC14013BCP) where it clocks the high caused by CHKR at pin 5 to pin 1. The counter will continue to count down until it reaches zero when gate 347 pin 3 will go low and therefore terminate the CHKR signal. CHKR is also applied to pin 3 of the inverter 361 (MC14049BCP) the output of which is applied to pin 4 of gate 359 and causes it to be reset. Hence gate 359 pin 1 will also go low and CHKL is terminated. The action of CHKR going low at pin 5 of gate 355 causes pin 1 thereof to be clocked low by the inverted SCLK. This will disable the gate 351 and cause the signal at pin 3 of gate 333 to cease so that the counter has no input to count and stops at its quiescent state of zero. The counters 335, 337, 339, 341 are cascaded by connecting pin 7 of 335 to 5 of 345 etc. as specified by manufacturer. When a wheel 100 enters the active region of the sensor 50 during a check it is required that the check signal generator be reset. This is achieved by the reset check generator signal "RCG" applied to pins 9 of counters 335, 337, 339, and 341 and pin 4 of gate 355. The output of gate 359 pin 2 inhibits CHK signal ICHK which is the inverse of CHKL is applied to pin 2 of gate 230 where it inhibits the signal at pin 1 thereof for the duration that the CHKL signal is active. ICHK is also applied to the control pin 2 of gate 363 (MC14081BCP) where it inhibits the data at pin 1 for the duration of CHKL. The signal at pin 1 of gate 363 is CHKR so that the signal at pin 3 is a synchronized reconstituted CHK signal RCHK, which is applied to gate 315 pin 2 as described above. The existence of a check signal which must be overridden by a wheel 100 entering the sensor 50 active region requires that certain interlocks protect the sensor 50 from ambiguous operation. These interlocks are present as circuits 150 and 163. Circuit 150 ensures that the signals present in the detection system are cancelled on the entry of a wheel 100 into the sensor 50 active region enabling the detector filters items 123 to re-establish to the new input signals with check absent. The signal LHS $\overline{II}$ from amplifier 217 pin 2 is applied to the NAND gate (BC108) 301 pin 2 so that a wheel entering left will steer the check interlock signal "CIL$\overline{I}$" to discharge the output of filter 123. Similarly, RHS$\overline{II}$ will control the discharge of filter 123 (ALHS) via NAND gate (BC108) 301 pin 1. The filters items 123 will only be discharged if the CIL$\overline{I}$ signal is active. This signal is obtained from pin 3 gate 254 the operation of which has already been discussed. CIL$\overline{I}$ will thus be active if CHKR is active and then a WP$\overline{II}$ occurs i.e. a wheel 100 arrives during a check.

Figure 18:
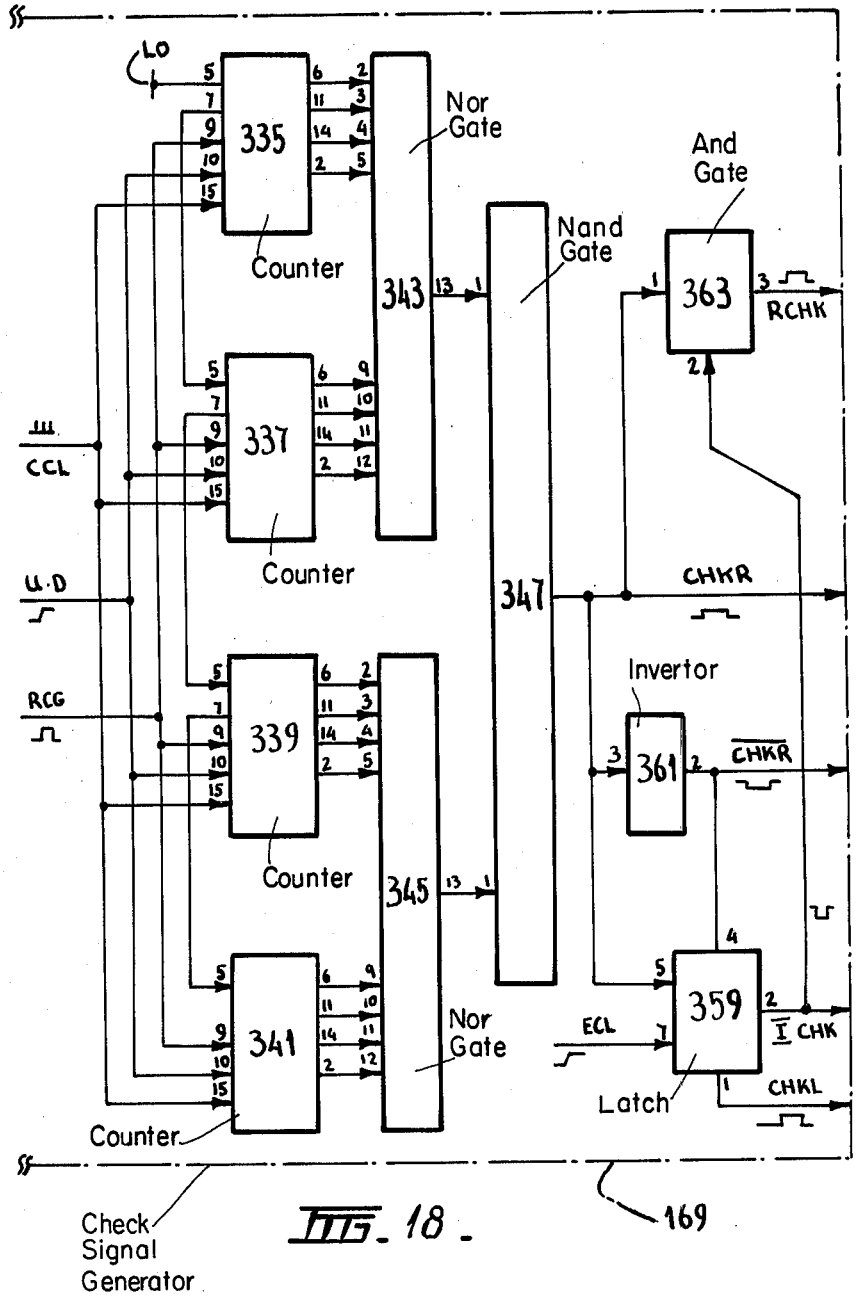
Figure 19:
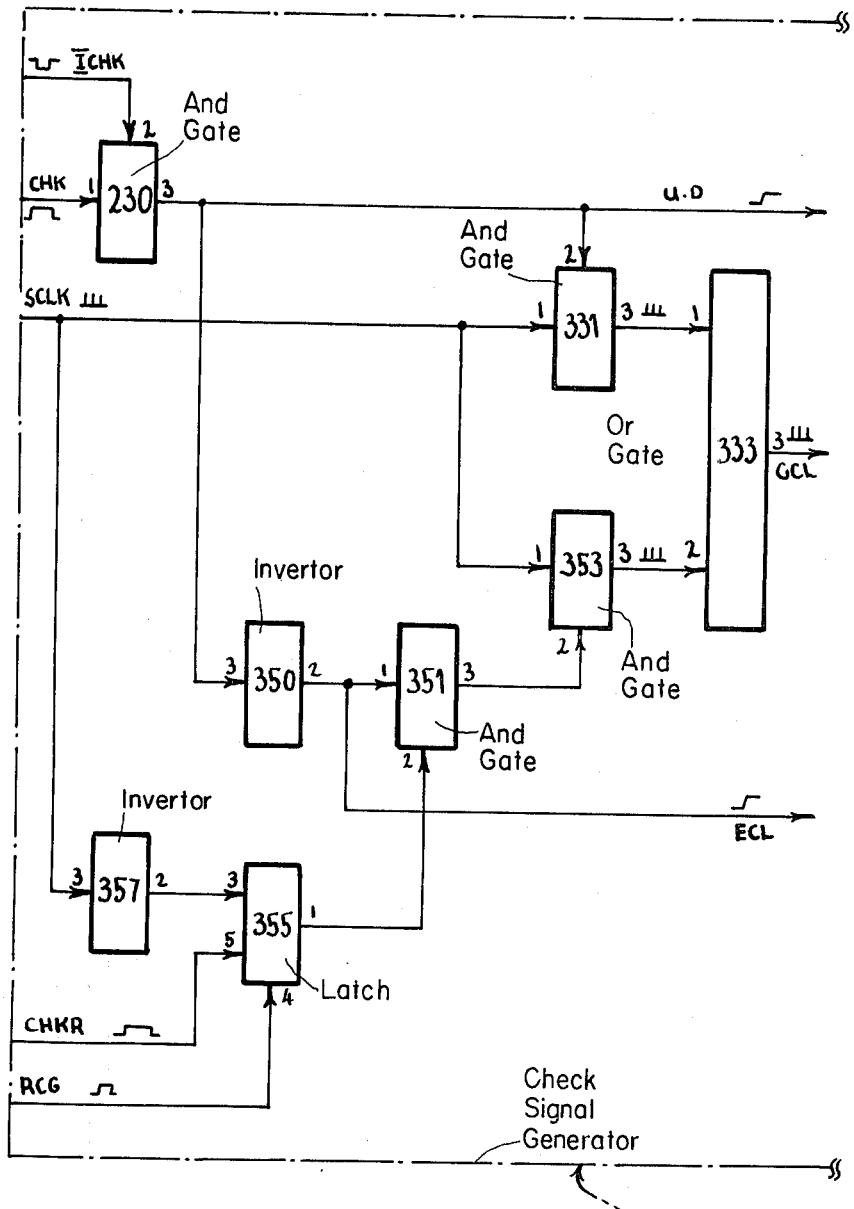

In order that it may be determined when a wheel 100 leaves the active region of the sensor 50 an end of WP$\overline{I}$ signal is required. Once this pulse has occurred each transaction is regarded as being complete. If the WP$\overline{I}$ signal becomes active after EWP$\overline{I}$ then the sensor will be reset and treat the new signal as a new transaction. The WP$\overline{I}$ signal derived from gate 225 pin 3 FIG. 11 is applied to an inverter 364 pin 3 (MC14049BCP) FIG. 15 the output of which pin 2 is applied to a pulse generator comprising circuits 367 and 369 (MC14013BCP) via an AND inhibit gate 368 (MC14081BCP). The inhibit gate 368 is normally transparent and the signal at pin 1 propagates to pin 3 where the positive edge of WP$\overline{I}$ is inverted, i.e. the negative edge of WP$\overline{I}$ will clock gate 367 and transfer the high at pin 5 to pin 1. This signal then becomes the data for latch 369 and is transferred to pin 1 thereof by the next system clock pulse which occurs at pin 3. Pin 1 of latch 369 is then applied to the reset pin 1 of gate 367 and so forcing pin 1 to logical low. This low is then clocked through to pin 1 and so forming a positive pulse of one clock pulse duration at pin 1. This signal is EWP$\overline{I}$. For the duration of the pulse the input is inhibited by connecting the output pin 2 of gate 369 to the control pin 2 of gate 365 and stopping the data at pin 1. The signal at pin 2 of gate 368 is otherwise high ensuring that the gate is normally transparent as assumed above. Gate 313 provides a signal that indicates that a wheel 100 has entered the sensor active region during a check. Note that this signal will occur when if the wheel 100 only enters the WP$\overline{I}$ active region since the sensitivities of the sensors 50, circuit 157 are adjusted so that a wheel 100 causing WPI together with a check disturbance will cause a WP$\overline{II}$ signal. The CHKR signal from gate 347 pin 3 (FIG. 18) is applied as data to pin 5 of gate 313 (MC140138CP). If a WP$\overline{II}$ signal occurs while CHKR is active gate 313 will be clocked by WP$\overline{II}$ at pin 3 and force pin 1 high. Gate 313 is reset by connecting EWPI to pin 4. Thus a pulse is formed which is started by WP$\overline{II}$ and ended by EWP$\overline{I}$. The inverse of this signal obtained gate 313 pin 2 inhibit multiple signature "IMS" is applied to the control pin 2 of gate 303 in order to inhibit further triggering of the pulse generator 307, 309, 311. If a wheel 100 arrives prior to a check latch 365 (MC14013BCP) is used to create a signal which inhibits the initiation of a check until the wheel 100 departs the sensor 50. The inverse of CHKR derived from gate 361 pin 2 FIG. 18 is applied to pin 5 of latch 365 where it is transferred to pin 1 if a WP$\overline{I}$ signal occurs at pin 3 and so forcing pin 1 high. An EWP$\overline{I}$ signal from gate 369 pin 1 is applied at gate 365 pin 4 in order to reset that gate. The two signals at gate 365 pin 1 and gate 313 pin 1 are both combined in the OR gate 366 (MC14071BCP) to produce at pin 3 a reset check generator signal "RCG" which is applied to pin 9 of counters 335, 337, 339 and 341 and pin 4 of gate 355.

Referring now again to FIG. 2 the wheel count outputs Wcc from each of the sensors 1, 2,3,4,5 and 6 are fed into counters 17 for example, if a train enters left to right, sensor 1 provides a wheel count to counter 17 between sensors 1 and 2 and this counter 17 'up' counts the number of wheels passing. The velocity signal of the train passing sensor 1 is sent to a gate 14 which will provide a high output after time determined having regard to the speed of passing $\overline{V}$c of the train and the distance of the sensor 1 from the crossing. Thus the warning signal activating circuit 15 is set by the high output from comparator is ready for a high output from gate 14, so that on occurrence of both signals together the warning signal activating circuit 15 will switch on the flashing lamps or bells or drop boom gates at the crossing.

When the train reaches sensor 2 it provides a wheel count signal Wcc and direction signal WDC which is fed back to the counter 17 between sensor 1 and sensor 2 and the counter 'down' counts. When the first 'up' count is made in the counter 17 a wheel present signal Wp' either a high or low signal only is fed to the 'look-up' table comparator 13 and this wheel present signal Wp' does not disappear from counter 17 output until the 'down' count equals the 'up' count (net count equal to zero).

As the train progresses past sensor 2 the wheel count signal is also fed into the next counter 17 between sensor 2 and sensor 3 as an 'up' count. As the train progresses through the crossing the various counters 17 count up and then down, counting off the up count. If there is any count residue then the wheel present signal Wp' remains.

Each of the counters 17 has a light engine detector 18 connected therewith. The detector 18 is arranged to provide a high output for feeding to the "look-up" table comparator 13 until the count reaches a set number as for example 6. The heavy engine (train) will have greater than 6 wheels and thus by providing the high output when that number is exceeded the train can be distinguished from the light engine which has less than 6 wheels. Thus the light engine can be recognized and the warning signals activated as required. This is provided because often the light engine, will enter the crossing system but may not intend to cross the road. Thus, the road traffic will not be required to stop unless the light engine intends to cross.

The wheel direction information Wdc from each sensor 1 to 6 is applied to look-up table comparator 13 as a high or a low signal only—a low signal, ie. no signal pulse output from the sensor 50 represents train movement Left to Right. A high signal representing train movement Right to left.

Thus, all the detailed information concerning the train movement is reduced to two level binary signals indicating presence or no presence.

The "look-up" table comparator 13 is a simple binary comparator which can be duplicated by any skilled electronics addressee knowing the end requirement. It is pre-set to recognise binary high or low signals at its inputs, having regard to the particular crossing and the number of sensors used so that the pattern of highs or lows at its input is recognized as requiring a high output or a low output. Thus, the signal activating circuit 15 is activated when there is a high at both inputs.

When using the system in other applications the required number of sensors are placed at the required positions and the "look-up" table comparator 13 arranged to recognized particular patterns of high or low inputs and to react accordingly to give a high or low output to the signal activating means 15.

The signals provided at the output of combining circuit 171 are fed via cables to the respective further circuits. Desirably, the cables have a suitable 'interface' to ensure that spurious signals do not appear thereon such as for example by lightning induced currents in the cables. Such 'interface' circuitry should also desirably have protective circuit components therein to cancel or short spurious currents to inhibit damage to the circuits such as during lightning.

The total system is checked as to operation not only at each of the sensors, but to the extent of all the integers. The checking is performed by activating a check input signal to one or all of the sensors, check signal generators 169, and obtaining an output from combining gate 171 which is identifiable as Wpc with no signature thereon. The output signal of velocity $\overline{V}c$ is compared with the input check signal from the check signal generators 169 to see if they are within a given time tolerance of each other. This inturn detects that the system is checked operational, if a pattern of check signals representing a check train through all the sensors then the total system can be checked, including outputs to warning signals only if required.

I claim:

1. A system controlling apparatus comprising:

an array of sensors each for detecting information concerning passing articles and for providing signals indicative of the information, each of said sensors being magnetic field proximity sensors, passing articles disturbing a magnetic field, each of said sensors having two transducers spaced less than the length of each of said articles to be detected and wherein each of said transducers includes means for creating said magnetic field, and sensing means disposed within said magnetic field and responsive to changes in said magnetic field such that when said magnetic field is disturbed by the proximity of each article, the sensing means operates to provide information as to that article;

field disturbing means for disturbing said magnetic field whereby to cause the sensing means to operate and provide a facility for simulating the disturbance of the field that would be caused by the proximity of each article; and signal processing means for comparing the signals with predetermined parameter information as to the system and for providing predetermined control to the system in response to detecting equality between the signals and the predetermined parameter information and for providing an overriding control to the system in response to detecting inequality between the signals and the predetermined parameter information.

2. A system as claimed in claim 1 wherein the signal processing means includes a counter between adjacent sensors for counting up or down as each article passes one of said adjacent sensors and for counting off the counts as the article passes the other of said adjacent sensors, said counters arranged for providing binary high or low outputs when there is a count other than zero, said counters binary high or low outputs being connected to a look-up table comparator arranged to recognize particular patterns of high or low signals at its input and to provide a high or low output to said system, if the pattern recognized requires control to be effected.

3. A system controlling apparatus comprising:

an array of sensors for detecting information concerning passing articles and for providing signals indicative of the information; and signal processing means for comparing the signals with predetermined parameter information as to the system and for providing predetermined control to the system in response to detecting equality between the signals and the predetermined parameter information and for providing overriding control to the system in response to detecting inequality between the signals and the predetermined parameter information, the signal processing means including a counter between adjacent sensors for counting up or down as each article passes one of said adjacent sensors and for counting off the counts as the article passes the other of said adjacent sensors, said counters arranged for providing binary high or low outputs when there is a count other than zero, said counters binary high or low outputs being connected to a look-up table comparator arranged to recognize particular patterns of high or low signals at its input and to provide a high or low output to said system, if the pattern recognized requires control to be effected and wherein each sensor provides a velocity signal for each passing article and wherein said velocity signal is fed to a gate which provides a high or low output signal after a predetermined time, related to distance of sensor from a point in the system where control is required having regard to the article velocity, and wherein the output signal of said gate is connected to said system to delay operation of said system by said comparator.

4. A system controlling apparatus comprising:

an array of sensors for detecting information concerning passing articles and for providing signals indicative of the information; and signal processing means for comparing the signals with predetermined parameter information as to the system and for providing control to the system in response to detecting equality between the signals and the predetermined parameter information and for providing an overriding control to the system in response to detecting an inequality between the signals and the predetermined information, the signal processing means including a counter between adjacent sensors for counting up or down as each article passes the sensor and for counting off the counts as the article passes the next adjacent sensor, said counters arranged for providing binary high or low outputs when there is a count other than zero, said counters binary high or low outputs being connected to a "look-up" table comparator arranged to recognize particular patterns of high or low signals at its input and to provide a high or low output to said system, if the pattern recognized requires control to be effected and wherein each sensor provides a velocity signal for each passing article and wherein said velocity signal is fed to a gate which provides a high or low output signal after a predetermined time, related to distance of sensor from a point in the system where control is required having regard to the article velocity, and wherein the output signal of said gate is connected to said system to delay operation of said system by said comparator and wherein said sensor is a magnetic field proximity sensor and said article can disturb a magnetic field, said sensor having two transducers spaced less than the length of the article to be detected and wherein each of said transducers comprise, field creating means, sensing means positioned to be within that field and responsive to changes in that field such that when it is disturbed by the proximity of the article, the sensing means operates to provide information as to the article and wherein there is included additional field creating means for disturbing the field of the field creating means, whereby to cause the sensing means to operate, and additionally provides a checking facility for the system by simulating the disturbance of the field which would be caused by the proximity of the article.

5. A system as claimed in claim 4 wherein said sensing means is a pick-up coil and said field creating means is a coil and voltage supplying means, and said additional field creating means is a coil, and wherein said field creating coil is in two parts, one part is wound around an elongated core so that the field created thereby will be directed longitudinally of the core, the other part is similarly wound on another elongated core, the longitudinal axis of both of said cores being fixed at right angles to one another, and wherein said additional field creating coil is wound around a further elongated core so that field induced therein will be directed longitudinally of the core, said further core being fixed at right angles to both of the other cores with all core axes intersecting, and wherein a system threshold field will emanate from said further elongated core from the point of intersection of the axis.

6. A system controlling apparatus comprising:

an array of sensors for detecting information concerning passing articles and for providing signals indicative of the information; and signal processing means for comparing the signals with predetermined parameter information as to the system and for providing control to the system in response to detecting equality between the signals and the predetermined parameter information and for providing overriding control to the system in response to detecting inequality between the signals and the predetermined parameter information, the signal processing means including a counter between adjacent sensors for counting up or down as each article passes one of said adjacent sensors and for counting off the counts as the article passes the other of said adjacent sensors, said counters arranged for providing binary high or low outputs when there is a count other than zero, said counters binary high or low outputs being connected to a look-up table comparator arranged to recognize particular patterns of high or low signals at its input and to provide a high or low output to said system, if the pattern recognized requires control to be effected and wherein each sensor provides a velocity signal for each passing article and wherein said velocity signal is fed to a gate which provides a high or low output signal after a predetermined time, related to distance of sensor from a point in the system where control is required having regard to the article velocity, and wherein the output signal of said gate is connected to said system to delay operation of said system by said comparator and wherein said sensor is a magnetic field proximity sensor and said article can disturb a magnetic field, said sensor having two transducers spaced less than the length of the article to be detected and wherein each of said transducers comprise, field creating means, sensing means positioned to be within that field and responsive to changes in that field such that when it is disturbed by the proximity of the article, the sensing means operates to provide information as to the article and wherein there is included additional field creating means for disturbing the field of the field creating means, whereby to cause the sensing means to operate, and additionally provides a checking facility for the system simulating the disturbance of the field which would be caused by the proximity of the article and wherein said sensing means is a pick-up coil and said field creating means is a coil and voltage supplying means, and said additional field creating means is a coil, and wherein said field creating coil is in two parts, one part is wound around an elongated core so that the field created thereby will be directed longitudinally of the core, the other part is similarly wound on another elongated core, the longitudinal axis of both of said cores being fixed at right angles to one another, and wherein said additional field creating coil is wound around a further elongated core so that the field induced therein will be directed longitudinally of the core, said further core being fixed at right angles to both of the other cores with all core axes intersecting, and wherein a system threshold locus will emanate from said further elongated core from the point of intersection of the axis and wherein said additional field creating coil is in two parts, one part being at a position where the field is a minima when an article is not in proximity and the other part being at a position other than a minima and wherein said parts of said additional field creating means are electrically interconnected with a resistance and a switch, so that when the switch is closed the field at the one part will change and the voltage induced in the pick-up coil will change simulating the presence of an article.

7. A system as claimed in claim 6 wherein the value of the resistance is chosen so that the voltage induced in the pick-up coil on simulating the presence of an article will be lower than that when an article is in proximity so that the voltage induced by the proximity of an article can be distinguished from that when its presence is simulated and wherein there is logic means for preventing such information being applied to said "look-up" table comparator.

8. A system as claimed in claim 2 wherein said system is a railway system, said article is a train wheel and said control is for controlling operation of trains within the railway system.

9. A system as claimed in claim 2 wherein said system is a railway crossing system with sensors on each side of a crossing road.

* * * * *